US007290589B2

(12) United States Patent
Duncan et al.

(10) Patent No.: US 7,290,589 B2
(45) Date of Patent: Nov. 6, 2007

(54) CONTROL OF DEPOSITION AND OTHER PROCESSES

(75) Inventors: Stephen Richard Duncan, Ashendon (GB); Patrick Grant, Oxford (GB); Paul Jones, Jericho (GB); Timothy Rayment, Headington (GB)

(73) Assignee: Isis Innovation Limited, Oxford (GB)

( * ) Notice: Subject to any disclaimer, the term of this patent is extended or adjusted under 35 U.S.C. 154(b) by 425 days.

(21) Appl. No.: 10/469,738

(22) PCT Filed: Mar. 5, 2002

(86) PCT No.: PCT/GB02/00983

§ 371 (c)(1),
(2), (4) Date: Jan. 30, 2004

(87) PCT Pub. No.: WO02/070773

PCT Pub. Date: Sep. 12, 2002

(65) Prior Publication Data

US 2004/0112286 A1 Jun. 17, 2004

(30) Foreign Application Priority Data

Mar. 5, 2001 (GB) ..... 0105411.3

(51) Int. Cl.
*B22D 11/00* (2006.01)
*B05B 7/06* (2006.01)

(52) U.S. Cl. ..... 164/271; 164/46; 164/4.1; 427/345; 118/314

(58) Field of Classification Search ..... 164/46, 164/4.1, 271; 427/345; 118/314
See application file for complete search history.

(56) References Cited

U.S. PATENT DOCUMENTS

| | | | | |
|---|---|---|---|---|
| 4,129,092 | A * | 12/1978 | Wiggins | 118/323 |
| 4,505,945 | A | 3/1985 | Dubust et al. | 427/8 |
| 4,588,607 | A | 5/1986 | Matarese et al. | 427/34 |
| 4,897,283 | A | 1/1990 | Kumar et al. | 427/34 |
| 4,928,627 | A * | 5/1990 | Lindner | 118/718 |
| 5,047,612 | A | 9/1991 | Savkar et al. | 219/121.47 |
| 5,726,919 | A | 3/1998 | Azad et al. | 364/578 |
| 5,731,030 | A | 3/1998 | Friese et al. | 427/8 |
| 6,640,878 | B2 * | 11/2003 | Allor et al. | 164/150.1 |
| 6,945,306 | B2 * | 9/2005 | Duncan et al. | 164/46 |

FOREIGN PATENT DOCUMENTS

| | | |
|---|---|---|
| JP | 7302785 | 11/1995 |
| JP | 2000303159 | 10/2000 |
| WO | WO 00/11234 | 3/2000 |
| WO | WO 02/36845 | 5/2002 |

* cited by examiner

*Primary Examiner*—Kevin Kerns
*Assistant Examiner*—I.-H. Lin
(74) *Attorney, Agent, or Firm*—Gordon & Jacobson, PC

(57) ABSTRACT

Material is incrementally deposited using material directed toward a deposition zone. The scan path of the directed material is controlled according to a path plan derived to reduce derivation from an ideal uniform temperature profile for the deposition during the deposition process. A path plan having angled scan passes that intersect (or overcross one another), for example in a mirrorbox path plan, is preferred.

28 Claims, 15 Drawing Sheets

An "overly good" path plan

L_ x = 13inches

L_ y = 13inches

A "bad" path plan (Mode 5,3 excited)

L_ x = 13inches

L_ y = 13inches

A "Good" path plan (no low order modes excited)

L_ x = 13inches

L_ y = 13inches

CONTROL OF DEPOSITION AND OTHER PROCESSES

CROSS-REFERENCE TO RELATED APPLICATION

This application is a 371 of PCT/GB02/00983, filed Mar. 5, 2002.

BACKGROUND OF THE INVENTION

1. Field of the Invention

The present invention relates primarily to control for processes involving deposited material (such as for example molten metal spraying processes).

2. State of the Art

WO-A-96/09421 discloses a technique for spraying molten metal (particularly steel) to produce self supporting articles. In the process disclosed it is clear that for a practically realisable process, accurate control of the temperature of the sprayed metal droplets and/or the temperature of the already deposited material is important. Such considerations are also relevant to spraying of other materials and other deposition processes. Additionally other parameters for spray deposition processes require monitoring regulation and control.

The spray forming process deposits molten metal (typically from electric arc spray guns) onto a substrate (typically a ceramic substrate) to form a metal shell that accurately reproduces the topography of the ceramic substrate.

The molten metal is typically produced in the guns by direct current arcing between two oppositely charged wires made of the metal being sprayed. The arcing causes the wire tips to melt and a high-pressure inert gas stream continuously strips molten material from the arc, atomising it into a spray of droplets. The gas stream carries the droplets to the surface of the object where they are deposited. Wire is continuously fed to the arc gun to maintain the flow of sprayed metal and the amount of metal that is deposited can be adjusted by changing the feed rate of the wire. The droplet spray from the guns is scanned over the surface of the ceramic substrate by a robot in a pre-determined, repetitive manner, referred to as the "path plan".

The guns act not only as source of material but also as source of heat because the molten droplets transfer their heat to the spray formed metal shell as they cool and solidify to build up a solid metal shell. An important feature of the process described in WO-A-96/09421 is that it relies on the metal droplets undergoing prescribed phase transformations as they cool after being deposited on the surface of the sprayform. These phase transformations offset the natural contraction of the metal as it cools, allowing the dimensional accuracy of the sprayform to be maintained. In order to ensure that the required transformations occur, accurate regulation of the thermal history of the sprayed material is necessary. One method of regulating the thermal history is to ensure that the temperature of the surface at the point where the spray was deposited passes through a given temperature at a specific time after deposition. A system for regulating the thermal history of the deposited material has been proposed that adjusts one or more parameters including the height, velocity and path of the robot and the orientation of the guns. These adjustments are made relative to nominal or reference values for these variables and the purpose of the current invention is to specify a nominal path for the robot over the sprayform that will minimise the variations in temperature over the surface.

SUMMARY OF THE INVENTION

According to a first aspect, the present invention provides a system for incrementally depositing material, which system comprises:

delivery means for directing material toward a delivery zone;

control means for controlling operation of the delivery means, the control means controlling the deposition according to a derived path plan predicted to minimise/reduce deviation from an ideal uniform temperature profile during the deposition process.

According to a second aspect, the invention provides a control system for deposition apparatus, the control system controlling the deposition according to a derived path plan predicted to minimise/reduce deviation from an ideal uniform temperature profile during the deposition process.

According to a further aspect the invention provides a method of producing an article by a deposition process, the method comprising directing material toward a delivery zone and controlling the deposition according to a derived path plan predicted to minimise/reduce deviation from an ideal uniform temperature profile during the deposition process.

The material is typically delivered in flight, preferably as vapour/molten droplets. Typically the material may be delivered by spray delivery means. Molten droplets of the material are typically atomised in a conveying gas.

The delivery means is typically operable to produce a scanning or traversing pattern of material deposition or flight delivery over the deposition zone; the control means beneficially operates (at least initially) to the predetermined path plan having predetermined scan or traverse rate or scan movement direction.

The path plan preferably comprises a predetermined path plan derived by considering spatial modes and selecting spatial modes to optimise the scan launch angle and/or path plan length preferably without exciting lower order modes. The scan path plan preferably reflects at boundaries to form an overcrossing pattern at the deposition zone.

The path plan may comprise a repeating pattern returning to a start point following a plurality of scan passes over the deposition zone. Alternatively the path plan may comprise a non-repeating pattern, an artificial correction step may return the path to a common path point following a finite number of scan passes.

The predetermined path plan is beneficially derived in a process (preferably a computer software run process) in which one or more of the following input considerations are accredited:

optimisation criteria selected;

maximum acceptable deviation from desired thermal profile;

dimensions of the deposition zone size/dimensions of deposition footprint;

mass deposition criteria;

scan velocity.

Beneficially a scan angle is set in which:

having regard for the footprint of the spray gun, $\bar{f}(x, y, t)$, the coefficients, $\bar{b}_{m,n}$, are determined (typically when the gun effecting deposition is centred over the deposition zone surface);

Upper bounds, M and N are determined, such that $\{\bar{b}_{m,n} \approx 0 : m > M;\ n > N\}$;

Integers are selected, $\mu \leqq M$ and $\upsilon \leqq N$, such that $\mu \geqq \upsilon$ and $\mu$ and $\upsilon$ have no common factors;

Scan angle set to $$\tan\psi = \frac{\mu L_y}{\upsilon L_x}$$

Search over all modes, {m=1,2, . . . ,M,n=1,2, . . . ,N}, to ensure that all $q_{m,n}(t)$ satisfy the optimisation criterion for this scan angle.

If the criterion is not satisfied, increase υ and/or μ and repeat preceding steps (from 'Integers are selected' step);

If the criterion is satisfied, check that path satisfies mass deposition criterion;

If the mass deposition criterion is not satisfied, increase υ and/or μ and repeat preceding steps (from 'integers are selected' step).

If the mass deposition criterion is satisfied, use scan angle, ψ to generate robot path and download to control scan (download to scanning robot).

The system according to the invention is particularly suited to the production of articles in which localised differences in thermal conditions and/or thermal history can lead to differential thermal contraction and distortion. The optimised path plan selection and control enables the spraying regime for such large articles to be closely and accurately regulated.

UK Patent Application 0026868.0 (the entirety of which is incorporated herein by reference) relates to controlling deposition processes including the thermal profile of deposited material using real time monitoring of parameters (including thermal parameters) to ensure that a desired thermal history has occurred for deposited material.

The present invention is of benefit in its own right as providing for thermal history control by providing an optimised path plan for deposition. Alternatively, the present invention provides a useful adjunct for control processes such as that described in UK Patent Application 0026868.0 because a deposition process can initially be set up to run in accordance with the path plan derived according to the present invention and subsequently feedback monitored control input can be utilised if desired for more accurate or sophisticated control.

The system can be used to spray to a predetermined desired temperature profile at which different surface zones may be maintained at different temperatures at different times during the spraying process.

The present invention is also of benefit for controlling projected delivery/deposition processes (such as spraying) of materials having other parameters which are time variable (particularly following deposition). Examples of such situations and processes are heat flow, fluid flow, diffusion, decomposition and curing. This list is non-exhaustive. The invention may for example be utilised in processes such as paint spraying where fluid flow may occur following deposition.

According to a further aspect, the invention therefore provides A system for incrementally depositing material, which system comprises:

delivery means for directing material toward a deposition zone;

control means for controlling operation of the delivery means, the control means controlling the deposition according to a derived scan path plan predicted to minimise/reduce deviation from an ideal uniform parameter profile for the deposit during the deposition process.

According to a further aspect, the invention therefore also provides a control system for deposition apparatus, the control system controlling the deposition according to a derived scan path plan predicted to minimise/reduce deviation from an ideal uniform parameter profile for the deposit during the deposition process.

The invention as defined is applicable to minimise deviation from the ideal value for a parameter of the deposited material that has a tendency to vary over time. For example, the thickness of spray paint material may vary over time as the paint flows at the deposition zone. The preferred features of the invention in relation to deposit temperature profile optimisation may also be preferred in relation to optimisation of parameters for other spray deposited materials or processes. Particularly, scan path plans as defined in the claims having 'mirrorbox' or traversing scan passes as defined will improve the resultant deposition characteristics.

BRIEF DESCRIPTION OF THE DRAWINGS

The invention will now be further described in specific embodiments, by way of example only, and with reference to the accompanying drawings, in which.

DETAILED DESCRIPTION OF THE PREFERRED EMBODIMENTS

Figure 1:
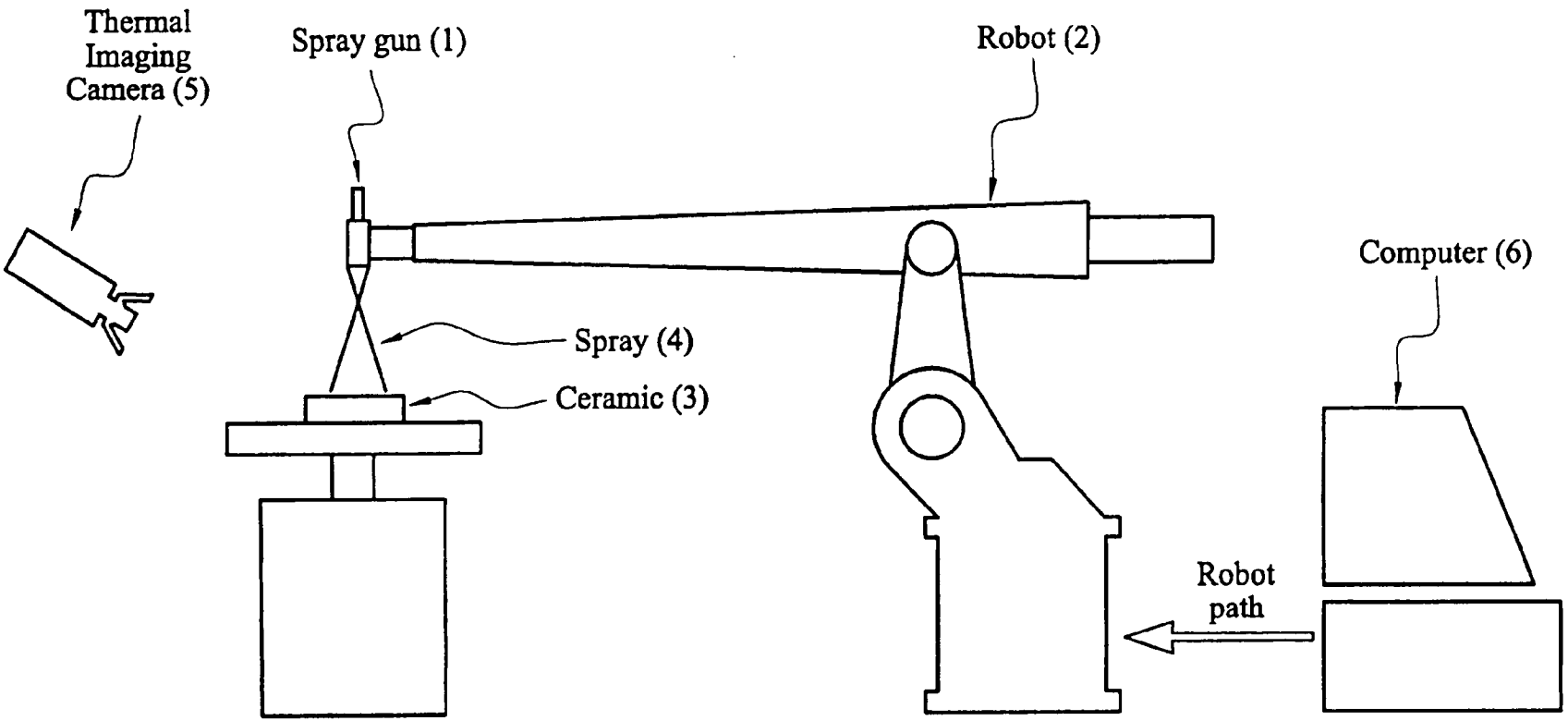
FIG. 1 is a schematic representation of a system according to the invention.

Referring to FIG. 1, in the embodiment described here the system consists of a single spray gun (1) spraying molten steel, mounted on a 6-axis industrial robot (2). The robot moves the spray gun over a ceramic former (3) and the metal deposited in the spray (4) builds up a metal shell. The temperature profile on the surface is recorded periodically by a thermal imaging camera (5). A computer (6) determines the path to be followed by the gun and downloads it to the robot.

In the invention described in UK Patent Application 0026868.0, adjustments are made to the path of the robot and to parameters such as the wire feed rate to achieve the desired thermal profile. In the invention described here, the height, robot velocity, gun orientation, robot path and wire feed rate are kept constant, but the robot velocity and path are chosen to minimise the variations in the thermal profile over the surface. This has two main purposes:

1. if no further control is applied, then maintaining the required uniform thermal profile over the surface minimises the net stresses and/or distortion across the sprayform, provided that the appropriate spray conditions are used;
2. if control of thermal history is applied as described in UK Patent Application 0026868.0, then adjustments real time to the robot velocity, robot height, path etc., will be made relative to the optimal, predetermined, nominal path.

Figure 2:
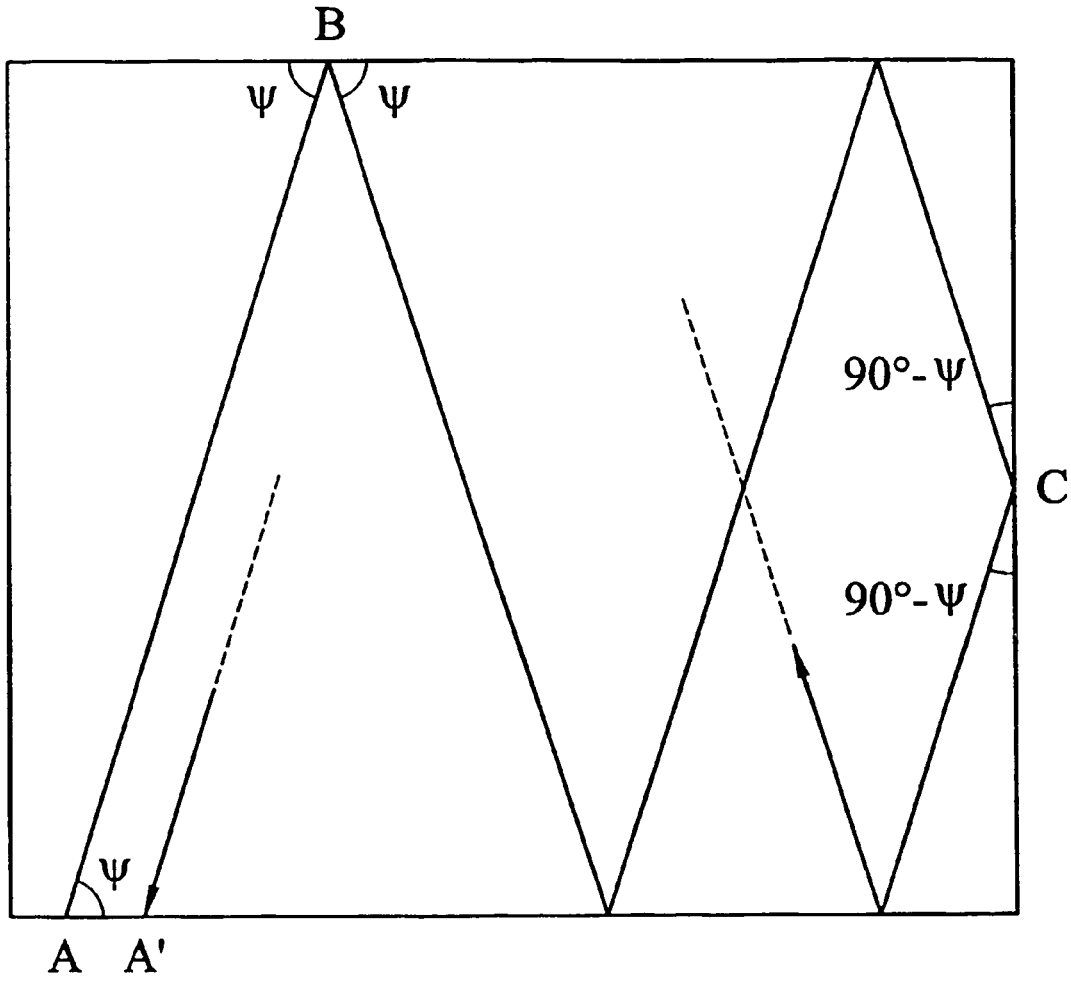
FIG. 2 is a representation of a path taken by robot as it scans across the surface of the sprayform deposition zone.

Consider spraying onto a flat rectangular sprayform of dimension $L_x$ in the x direction and $L_y$ in the y direction (other geometries will be described below). Viewed from above, FIG. 2 shows the path (path plan) taken by the spray from the gun (1) as it tracks across the surface, at constant velocity, v. The robot starts from a point (A) on one edge of the sprayform and tracks across the sprayform at an angle ψ, to this edge, until it reaches the opposite edge at point B, where they component of the velocity of the robot is reversed, so that the robot turns round and scans back at the same angle, ψ, to the edge. When the robot reaches the end of the sprayform at point C, the x component of the velocity of the robot is reversed and robot moves back in the negative x direction, making an angle of 90°-ψ to the edge.

In order to program the robot movements, it is necessary for the path to consist of a finite number of moves and the ideal path (from the programming point of view) is for the path to end at point A following a finite number of "reflections" at the edges. Under these circumstances, this "closed" path can be repeated either until a new path is determined or until spraying is complete. If the path does not pass through point A, then it is necessary to stop the robot at A', a point close to A, move the robot to point A and then restart the robot along the path. Because the path consists of a series of reflections when the robot reaches the edge of the sprayform, it is referred to as a "mirrorbox" pattern.

If the distance from the gun to the surface and the orientation of the gun remain constant, then for a flat surface, the shape of the "footprint", or thermal flux, striking the sprayform remains fixed as the robot moves the gun over the surface. The shape of the footprint in the current embodiment is a 2-dimensional Gaussian function. For a given thermal footprint, the invention determines the path (path plan) that minimises the deviations in the thermal profile over the surface by finding the optimal scan angle, ψ, and scan velocity, v. For ease of exposition, the current embodiment considers the case where $L_x \geqq L_x$ and 45 °≦ψ<90°, although the cases where $L_x < L_x$ and/or ψ<45° can be analysed by the same approach.

Mass is deposited onto the sprayform by the spray gun as it is moved over the surface by the robot. The invention describes the path (path plan) that the gun should follow in order to minimise the thermal variations over the surface of the sprayform.

According to one aspect, the invention requires knowledge of the thermal "footprint" of the gun, which describes the rate of heat deposited per unit area by the spray gun over the surface of the sprayform. Although the shape of the footprint remains constant, its location changes with time as the gun is moved over the sprayform. The present technique expresses the thermal footprint in terms of a 2-dimensional Fourier series, which describes the footprint as a weighted sum of 2-dimensional sinusoidal spatial components. The coefficients of this weighted sum are denoted by $b_{m,n}(t)$, where m and n are used to index the frequency of the spatial harmonics in the x and y dimensions, respectively. The coefficients, $b_{m,n}(t)$, vary with time as the spray gun is moved over the surface.

Because the thermal footprint is a smooth function the surface of sprayform (i.e it does not contain abrupt changes), the magnitude of the coefficients, $b_{m,n}(t)$, tends to zero as m and/or n become large, irrespective of the location of the spray gun. This shows that the thermal effect of the gun is concentrated in the low order spatial modes, i.e. those modes associated with low spatial harmonics. For a closed spray path, where the path that repeats itself after a fixed time interval, the launch angle (i.e the angle that the spray path makes with one edge of the sprayform), ψ, satisfies $$\tan\psi = \frac{m'}{n'}\frac{L_y}{L_x}$$

where m' and n' are two integers. The optimal launch angle is determined by choosing the smallest pair of integers, m' and n', such that $b_{m',n'}(t)$ is negligible throughout the spray path. Choosing this value of y avoids exciting those thermal modes for which $b_{m',n'}(t)$ are non-zero. Although any value of m' and n' for which $b_{m',n'}(t)$ is negligible could be used, choosing the smallest possible values shortens the length of the path, which simplifies the programming of the robot path. It is often necessary to minimise variations in the mass deposition, as well as variations in temperature, but because the thermal footprint is highly correlated with the mass deposition footprint, it is likely that an optimising the launch angle for even temperature deposition also optimises the deposition of mass.

The variations in temperature can be quantified in terms of its standard deviation at points over the entire surface. The effect of basing the path plan on the optimal launch angle y is to ensure that this standard deviation remains low throughout the path plan. It is possible to find a location for the spray gun during a non-optimal path plan, where the standard deviation of the temperature profile is less than the standard deviation achieved by the optimal path plan. However, for the non-optimal path, a low standard deviation at one location is offset by much larger standard deviations at other points along the path. The benefit of the optimal path is that the temperature profile has a low standard deviation throughout the path.

EXPERIMENTAL RESULTS

Three experiments were performed under the same spraying conditions but with different path plans. The spray guns were set at a distance of 160 mm from the surface of the sprayform and the robot moved at a constant velocity of 200 $mm.s^{-1}$. The guns each deposited mass at 1.8 $g.s^{-1}$ onto a square ceramic of dimensions 12 inches by 12 inches. The guns followed a fixed path plan which covered an area of 15 inches by 15 inches. The variations in the thermal profile were recorded by taking an image using a thermal imaging camera, one quarter of the way through each repeat of the path plan. From the recorded thermal images, the standard deviation of the temperature at each pixel was calculated.

Three different path plans were compared:

1. "Bad" mirrorbox (FIG. 13)—a path plan with a "poor" launch angle of 77.47° for the 15 inches by 15 inches pattern, which excites low order spatial modes associated with the thermal footprint of the guns
2. "Good" mirrorbox (FIG. 14)—a path plan with an optimised launch angle of 75.07 for the 15 inches by 15 inches pattern size that avoids the exciting the low order spatial modes associated with the thermal footprint of the guns
3. Raster pattern (FIG. 15) of size 15 inches by 15 inches where the guns scan across the sprayform in a direction parallel to one edge. When the guns reach the edge of the spray pattern, they are moved a short distance parallel to the other edge and then scan back across the sprayform parallel to the original track, but in the opposite direction. This is repeated until the guns reach the edge of the spray pattern when the path is reversed. This spray path is commonly used in spraying operations.

Figure 13:
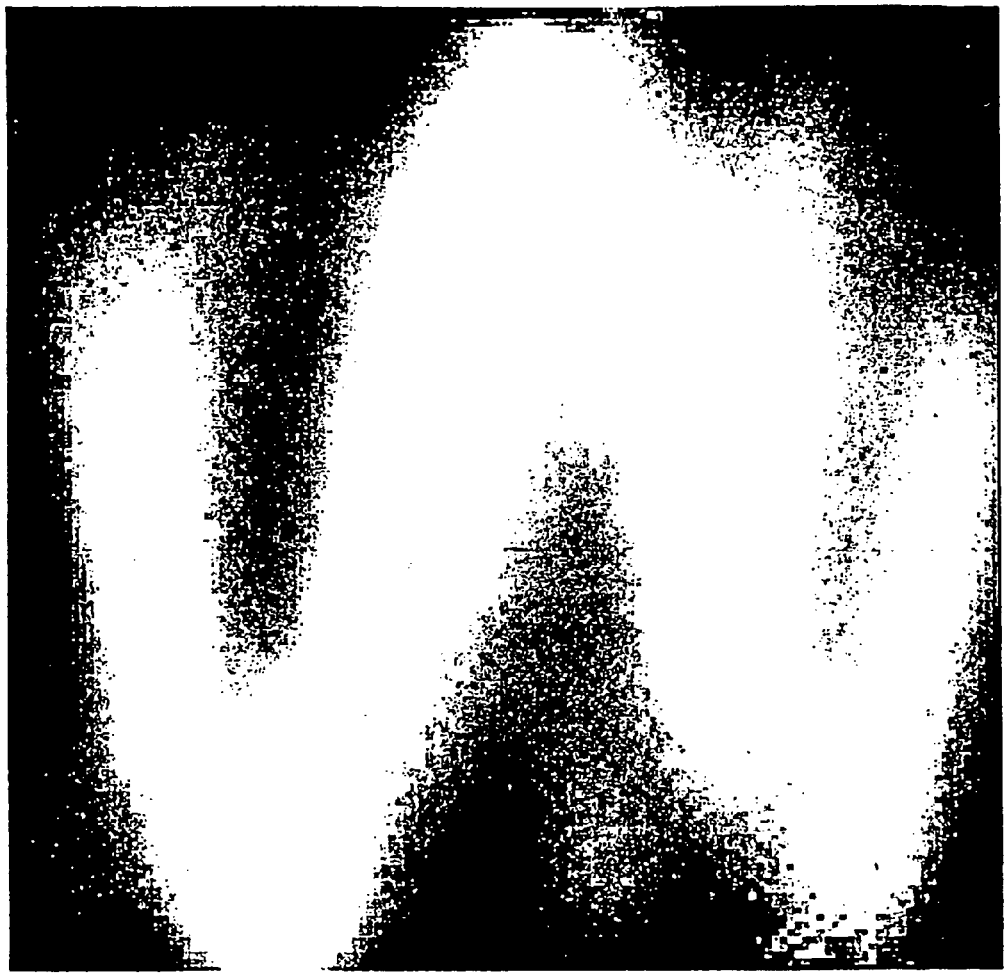
FIG. 13 is a thermal image of a poor "mirrorbox" scan path plan.
Figure 14:
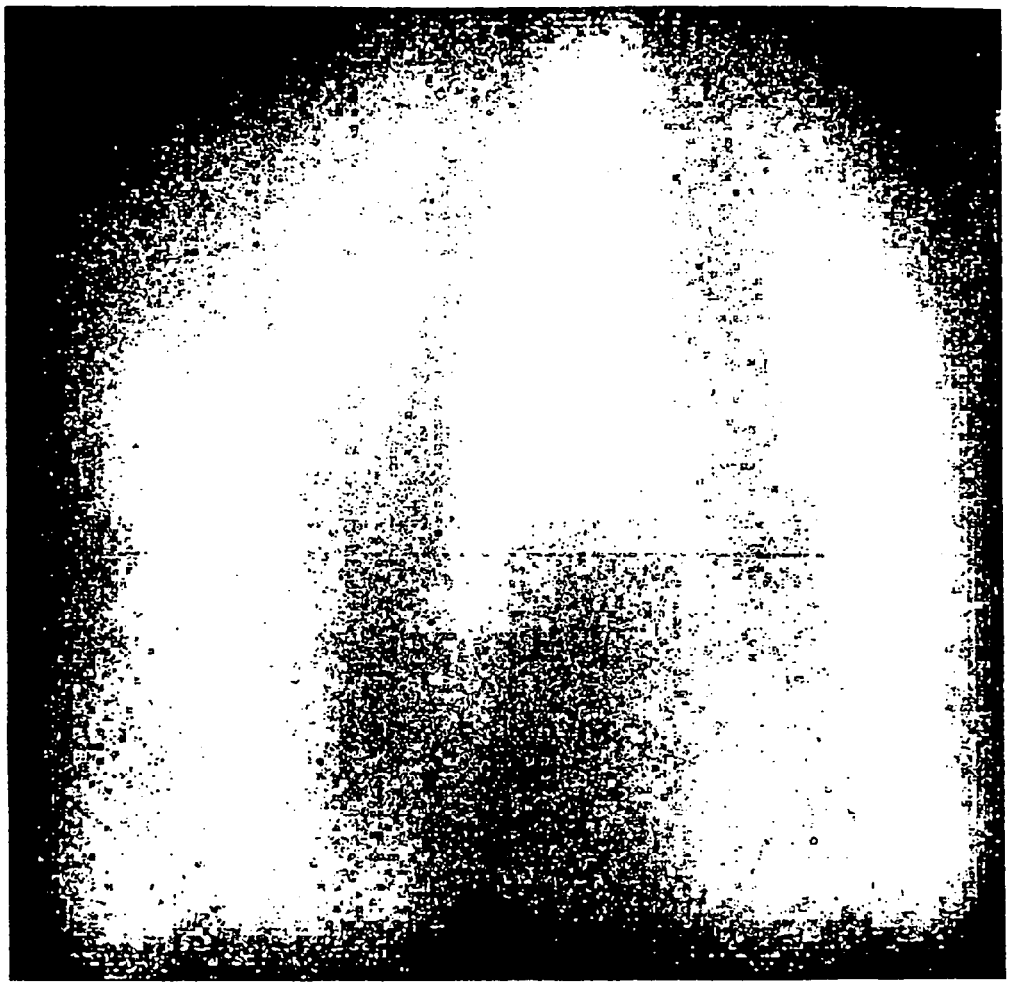
FIG. 14 is a thermal image of a good "mirrorbox" scan path plan.
Figure 15:
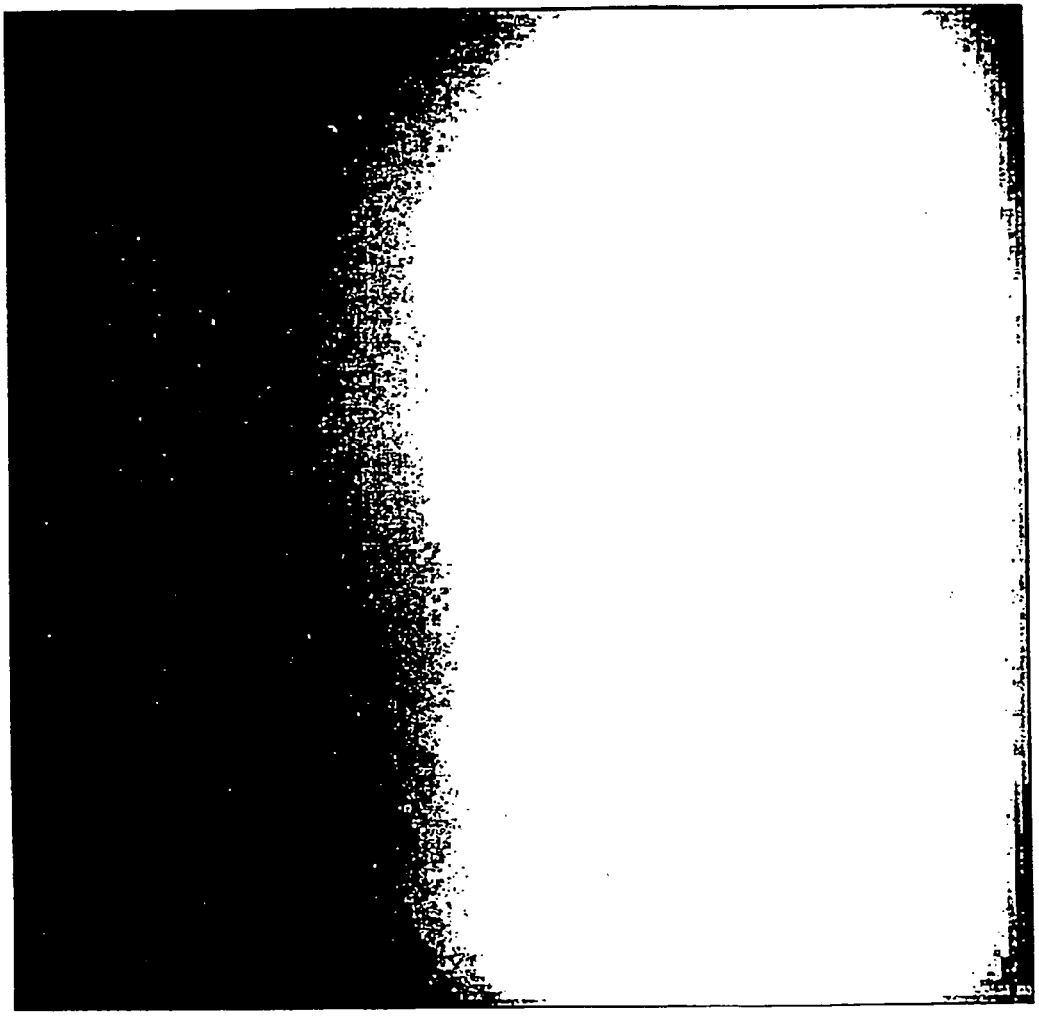
FIG. 15 is a thermal image of a raster scan path plan.

The image taken during the $14^{th}$ complete scan for each path plan was chosen as a typical result and analysed. The images for the bad mirrorbox pattern is shown in FIG. 13, while FIG. 14 shows the corresponding images for the good mirrorbox pattern. The corresponding image for the raster path plan is shown in FIG. 15. In each case, the lighter areas are the areas where the temperature of the surface is higher then the average temperature, while the darker areas correspond to regions where the sprayform is cooler than the average temperature. The images were analysed to determine the mean temperature over the sprayform, together with the standard deviation about the mean of the temperatures associated with the pixels in the mean.

| Path | Mean Temperature | Standard Deviation of Temperature |
|---|---|---|
| Bad mirrorbox | 256.4° C. | 16.5° C. |
| Good mirrorbox | 254.9° C. | 12.2° C. |
| Raster pattern | 260.3° C. | 28.5° C. |

The results show that the good mirrorbox has the thermal profile with the lowest standard deviation, indicating that it is the best path to use to minimise the variations in temperature over a scan. The benefits of the optimal path can also be seen, by examining a sequence of thermal images. The images in the raster sequence alternate between a low standard deviation and very high standard deviation, depending on the point in the scan where image is taken. By contrast, the good mirrorbox pattern maintains a low standard deviation throughout the scan and there is little difference in standard deviation of the images whenever they are taken.

Procedure for Determining Optimal Path

The procedure (shown in FIG. 12) for determining the optimal path is:

1. Choose optimisation criterion and maximum acceptable level of deviation from the desired thermal profile.
2. Input the dimensions of the surface, $L_x$, $L_x$ and the scan velocity, v.
3. Using the thermal footprint of the spray gun, determine the coefficients, $b_{m,n}$, when the gun is in the center of the sprayform.
4. Determine upper bounds, M and N, such that $b_{m,n}$ 0 for m>M and n>N
5. Choose integers, m and n, such that $m^3$ n and m and n have no common factors.
6. Set scan angle, y, to $$\tan\psi = \frac{\mu}{v}\frac{L_y}{L_x}$$

7. Search over all modes, {(n=1, 2, . . . , M, n=1, 2, . . . , N}, to ensure that the optimisation criterion is satisfied for this scan angle.
8. If the criterion is not satisfied, increase n and/or it and repeat from step 5.
9. If the criterion is satisfied, check that path satisfies mass deposition criterion.
10. If the mass deposition criterion is not satisfied, increase n and/or m and repeat from step 5.
11. If the mass deposition criterion is satisfied, use scan angle, y, to generate robot path and download path to robot.
12. Stop.

If it is not possible to find a scan angle that satisfies the optimisation criterion, then the scan velocity and/or the width of the spray footprint need to be increased until the procedure can find a suitable path.

Theoretical derivation of optimised path plan according to the invention is as follows.

Background: 2D Thermal Model

Partial Differential Equation

A 2D thermal model can be found using an energy balance for an element of the steel shell.

$$\Delta E_{element}=E_{conducted}-E_{convected}+E_{supplied} \quad (1)$$

where, $\Delta E_{element}$=increase in energy of element (J)

$E_{conducted}$=energy conducted into element (J)

$E_{convected}$=energy convected from element (J)

$E_{supplied}$=energy supplied by electric arc spray gun (J)

but, $$\Delta E_{element} = \rho c z(t)\frac{\partial\theta}{\partial t}\delta x\delta y \quad (2)$$

where, $\rho$=density of sprayed steel (kg $m^{-3}$)

c=specific heat capacity of sprayed steel (J $kg^{-1}$ $K^{-1}$)

z(t)=thickness of steel shell (m)

$\theta(x, y, t)$=temperature of element (K)

$\delta x\delta y$=area of element ($m^2$)

and, $$E_{conduction}=Kz(t)\nabla^2\theta\delta x\delta y \tag{3}$$

where,

K=thermal conductivity of sprayed steel (W $m^{-1}$ $K^{-1}$)

and $$\nabla^2\theta=\frac{\partial^2\theta}{\partial x^2}+\frac{\partial^2\theta}{\partial y^2} \tag{4}$$

and, $$E_{convection}=[H_a(\theta-\theta_a)+H_c(\theta-\theta_c)]\delta x\delta y \tag{5}$$

where, $H_a$=heat transfer coefficient from steel to air (W $m^{-2}$ $K^{-1}$)

$\theta_a$=temperature of air (K)

$H_c$=heat transfer coefficient from steel to ceramic (W $m^{-2}$ $K^{-1}$)

$\theta_c$=temperature of ceramic (K)

and, $$E_{supplied}=f(x, y, t)u(t)\delta x\delta y \tag{6}$$

where, f(x, y, t)=thermal footprint of arc spray gun (J kg $m^{-2}$)

$\upsilon(t)$=wire feed rate to gun (kg $s^{-1}$)

Substituting (2), (3), (5) and (6) into (1) gives $$\rho cz(t)\frac{\partial\theta}{\partial t}\delta x\delta y = Kz(t)\nabla^2\theta\delta x\delta y-(H_a[\theta-\theta_a]+H_c[\theta-\theta_c])\delta x\delta y+f(x, y, t)u(t)\delta x\delta y \tag{7}$$

and dividing through by $\rho cz(t)\delta x\delta y$ leads to $$\frac{\partial\theta}{\partial t}=\kappa\nabla^2\theta-H(t)\theta+\tilde{f}(x, y, t)u(t)+p(t) \tag{8}$$

where $$\kappa=\frac{K}{\rho c}$$

is the thermal diffusivity of sprayed steel and $$H(t)=\frac{H_a+H_c}{\rho cz(t)} \tag{9}$$

$$\tilde{f}(x, y, t)=\frac{f(x, y, t)}{\rho cz(t)} \tag{10}$$

-continued $$p(t)=\frac{H_a\theta_a+H_c\theta_c}{\rho cz(t)} \tag{11}$$

The time dependence in the thermal footprint comes from the presence of the term z(t) in the denominator and from the movement of the gun over the surface, so that $$f(x, y, t)=\frac{\bar{f}(x-\upsilon_x t, y-\upsilon_y t)}{\rho cz(t)} \tag{12}$$

where $\upsilon_x$ and $\upsilon_y$ are respectively, the robot velocity in the x and y directions and $\bar{f}(x', y')$ is the spray footprint, which is independent of the position of the gun over the surface.

Boundary Conditions

For a rectangular sheet of steel of length $L_x$ and width $L_y$ that is in contact with the air at the top and sides and underneath with the surface of the ceramic, the heat loss from the top and bottom surfaces are modelled by the term $H(t)\theta+p(t)$ in (8). Provided that the sheet is thin, i.e. $z(t)<<L_x$ and $z(t)<<L_y$, it can be assumed that no heat is transferred from the sides of the sheet giving the Neumann boundary conditions, $$\left.\frac{\partial\theta}{\partial t}\right|_{x=0}=0\quad\left.\frac{\partial\theta}{\partial x}\right|_{x=L_x}=0\quad\left.\frac{\partial\theta}{\partial y}\right|_{y=0}=0\quad\left.\frac{\partial\theta}{\partial y}\right|_{y=L_y}=0 \tag{13}$$

together with the final value condition, $$\theta(x, y, t)\rightarrow 0 \text{ as } t\rightarrow\infty \tag{14}$$

Solving the Partial Differential Equation

The aim is to solve (8) to find $\theta(x, y, t)$.

Homogeneous Part. Taking the homogeneous part of (8)

$$\frac{\partial\theta}{\partial t}=\kappa\nabla^2\theta-H(t)\theta \tag{15}$$

and assuming a separable solution of the form, $$\theta(x, y, t)=q(t)\phi(x, y) \tag{16}$$

then upon substituting (16) into (15) gives, $$q\phi=\kappa(q\phi_{xx}+q\phi_{yy})-H(t)q\phi \tag{17}$$

where, $$\phi_{xx}=\frac{\partial^2\phi}{\partial x^2}\quad\phi_{yy}=\frac{\partial^2\phi}{\partial y^2} \tag{18}$$

Rearranging to get expressions in t on the left and expressions in (x, y) on the right, both sides can be set equal to a constant $\alpha$ giving, $$\frac{\dot{q}}{\kappa q} + \frac{H(t)}{\kappa} = \frac{(\phi_{xx} + \phi_{yy})}{\phi} = \alpha \tag{19}$$

This can be split into, $$q + \backslash H(t) - q = 0 \tag{20}$$

and $$\phi_{xx} + \phi_{yy} - \alpha\phi = 0 \tag{21}$$

Separating the solution for (21), $$\phi(x, y) = X(x)Y(y) \tag{22}$$

and substituting (22) into (21) gives, $$X''Y + XY'' - \alpha XY = 0 \tag{23}$$

Rearranging to get expressions in x on the left and expressions in y on the right and setting both sides equal to a constant β, gives $$\frac{X''}{X} = -\frac{Y''}{Y} + \alpha = \beta \tag{24}$$

which can be split into, $$X'' - \beta X = 0 \tag{25}$$

and $$Y'' - (\alpha - \beta)Y = 0 \tag{26}$$

There are now three ordinary differential equations (ODE's), (20), (25) and (26), which can be solved. (20) is a homogeneous first order linear ODE, whose solution is $$q(t) = A \exp(-\int [H(t) - \kappa\alpha] dt) \tag{27}$$

where A is a constant of integration. This satisfies the final value condition (14), provided that $\int [H(t) - \kappa\alpha] dt \rightarrow \infty$ as $t \rightarrow \infty$.

Equation (25) is a second order ODE, which has a solution for $\beta = -p^2$:

$$X(x) = C \cos px + D \sin px \tag{28}$$

Applying the boundary conditions in (13) gives, $$X_m(x) = C_m \cos\left(\frac{m\pi}{L_x} x\right) \tag{29}$$

$$\text{where, } p = \frac{m\pi}{L_x}$$

Following a similar argument for (26) and writing $(\alpha - \beta) = -q^2$, gives $$Y_n(y) = E_n \cos\left(\frac{n\pi}{L_y} y\right) \tag{30}$$

where, $q = n\pi/L_y$.

Substituting (29) and (30) into (22) gives, $$\phi_{m,n}(x, y) = C'_{m,n} \cos\left(\frac{m\pi}{L_x} x\right) \cos\left(\frac{n\pi}{L_y} y\right) \tag{31}$$

where $C_{m,n} = C_m E_n$. Since $\beta = -p^2$ and $(\alpha - \beta) = -q^2$, then by defining $\lambda_{m,n} = -\alpha$ $$\lambda_{m,n} = \pi^2 \left(\frac{m^2}{L_x^2} + \frac{n^2}{L_y^2}\right) \tag{32}$$

Combining (31), (27), (32) and (16) gives the full solution to the homogeneous part of the PDE, $$\theta(x, y, t) = \sum_{m=0}^{\infty} \sum_{n=0}^{\infty} q_{m,n}(t) \phi_{m,n}(x, y) \tag{33}$$

$$\text{where, } q_{m,n}(t) = F_{m,n} \exp\left(-\int [H(t) + \kappa\lambda_{m,n}) dt\right) \tag{34}$$

$$\phi_{m,n}(x, y) = \cos\left(\frac{m\pi}{L_x} x\right) \cos\left(\frac{n\pi}{L_y} y\right) \tag{35}$$

with $F_{m,n} = AC_{m,n}'$.

Complete Solution Substituting equation (33) into equation (8) gives, $$\sum_{m=0}^{\infty} \sum_{n=0}^{\infty} \dot{q}_{m,n}(t) \phi_{m,n}(x, y) = \sum_{m=0}^{\infty} \sum_{n=0}^{\infty} q_{m,n}(t) \left[\kappa \frac{\partial^2 \phi_{m,n}}{dx^2} + \kappa \frac{\partial^2 \phi_{m,n}}{dy^2} - H(t)\phi_{m,n}(x, y)\right] + \tilde{f}(x, \bar{y}, t)\tilde{u}(t) + p(t) \tag{36}$$

$$\text{but } \frac{\partial^2 \phi_{m,n}}{\partial^2 x} + \frac{\partial^2 \phi_{m,n}}{\partial^2 y} = -\lambda_{m,n} \phi_{m,n} \tag{37}$$

which gives, $$\sum_{m=0}^{\infty} \sum_{n=0}^{\infty} \dot{q}_{m,n}(t) \phi_{m,n}(x, y) = \sum_{m=0}^{\infty} \sum_{n=0}^{\infty} -[H(t) + \kappa\lambda_{m,n}] q_{m,n}(t) \phi_{m,n} + \tilde{f}(x, y, t) u(t) + p(t) \tag{38}$$

Multiplying both sides by $\phi_{m',n'}(x, y)$ and integrating gives, $$\sum_{m=0}^{\infty} \sum_{n=0}^{\infty} \dot{q}_{m,n} \int_0^{L_y} \int_0^{L_x} \phi_{m',n'} \phi_{m,n} \, dx dy = \sum_{m=0}^{\infty} \sum_{n=0}^{\infty} -[H(t) + \kappa\lambda_{m,n}] q_{m,n} \int_0^{L_y} \int_0^{L_x} \phi_{m',n'} \phi_{m,n} \, dx dy + \tag{39}$$

-continued $$u(t)\int_0^{L_y}\int_0^{L_x}\phi_{m',n'}\tilde{f}(x,y,t)dxdy+p(t)\int_0^{L_y}\int_0^{L_x}\phi_{m',n'}dxdy$$

Using the orthogonality of $\phi_{m,n}(x, y)$ $$\int_0^{L_y}\int_0^{L_x}\phi_{m',n'}\phi_{m,n}dxdy=\begin{cases}\frac{L_xL_y}{4} & \text{for } m=m' \text{ and } n=n'\\ 0 & \text{for } m\neq m' \text{ or } n\neq n'\end{cases} \tag{40}$$

together with $$\int_0^{L_y}\int_0^{L_x}\phi_{m',n'}dxdy=\begin{cases}L_xL_y & \text{for } m'=0 \text{ and } n'=0\\ 0 & \text{for } m'\neq 0 \text{ or } n'\neq 0\end{cases} \tag{41}$$

reduces (39) to $$\dot{q}_{m,n}=-[H(t)+\kappa\lambda_{m,n}]q_{m,n}+u(t)\frac{4}{L_xL_y}\int_0^{L_y}\int_0^{L_x}\phi_{m,n}\tilde{f}(x,y,t)dxdy \tag{42}$$

Remark. There will be an additional term, $p(t)L_xL_y$, that is added to the expression for $q_{0,0}$, but because this only affects the DC mode, this term will be ignored.

If $b_{m,n}(t)$ is used to denote $$b_{m,n}(t)=\frac{4}{L_xL_y}\int_0^{L_y}\int_0^{L_x}\tilde{f}(x,y,t)\phi_{m,n}dxdy \tag{43}$$

then rearranging (42) gives, $$\dot{q}_{m,n}(t)=-[H(t)+\kappa\lambda_{m,n}]q_{m,n}(t)+b_{m,n}(t)u(t) \tag{44}$$

for each thermal mode.

Impulsive Heat Source

Consider the case of a rectangular surface of length $L_x$ and width $L_y$, insulated on all sides, which is healed by an impulse heat source moving with velocity $\nu$ at an angle $\psi$ to the side of the rectangle. The velocity of the source call be split into its components in the x and y directions giving, $$\nu_x=\nu\cos\psi t \tag{45}$$

and, $$\nu_y=\nu\sin\psi t \tag{46}$$

If the spatial profile of the heat source is a delta function, then (to within a scaling factor)

$$\tilde{f}(x,y,t)=\delta(x-\nu_xt,\ y-\nu_yt) \tag{47}$$

Each of the states associated with the spatial modes satisfies (44) where, $$b_{m,n}(t)=\frac{4}{L_xL_y}\int_0^{L_y}\int_0^{L_x}\delta(x-\upsilon_xt,\ y-\upsilon_yt)\cos\left(\frac{m\pi x}{L_x}\right)\cos\left(\frac{n\pi y}{L_y}\right)dxdy \tag{48}$$

$$=\frac{4}{L_xL_y}\cos\left(\frac{m\pi\upsilon_x}{L_x}t\right)\cos\left(\frac{n\pi\upsilon_y}{L_y}t\right) \tag{49}$$

Because the system is assumed to have Neumann boundary conditions the spatial eigenfunctions, $\phi_{m,n}(x, y)$ consist of cosine functions. As a result, $\phi_{m,n}(x, y)$ is an even function with respect to both x and y, so this expression for $b_{m,n}(t)$ holds as the sign of $\nu_x$ and $\nu_y$ switches when the heat source changes direction at the edge of the surface.

The expression for $b_{m,n}(t)$ in (49) can be rearranged using a trigonometric identity to give, $$b_{m,n}(t)=\frac{2}{L_xL_y}\left[\cos\left(\frac{m\pi\upsilon_x}{L_x}+\frac{n\pi\upsilon_y}{L_y}\right)t+\cos\left(\frac{m\pi\upsilon_x}{L_x}-\frac{n\pi\upsilon_y}{L_y}\right)t\right] \tag{50}$$

$$=\frac{2}{L_xL_y}[\cos\omega_1t+\cos\omega_2t] \tag{51}$$

$$\text{where, } \omega_1=\frac{m\pi\upsilon_x}{L_x}+\frac{n\pi\upsilon_y}{L_y}\quad \omega_2=\frac{m\pi\upsilon_x}{L_x}-\frac{n\pi\upsilon_y}{L_y} \tag{52}$$

The term H(t) is time-varying due to the change in z(t), the mean thickness of the steel. Since the thickness builds up slowly, it is reasonable to assume that H(t) will remain approximately constant over the period of a complete cycle of scans. If the wire feed rate is also constant, so that $\upsilon(t)=\upsilon_0$, then applying Laplace transforms to (44) (assuming that $q_{m,n}(0)=0$) gives, $$sQ_{m,n}(s)=-[H(t)+\kappa\lambda_{m,n}]Q_{m,n}(s)+B_{m,n}(s)\upsilon_0 \tag{53}$$

which leads to an expression-for G(s), the transfer function from $B_{m,n}(s)$ to $Q_{m,n}(s)$ $$\frac{Q_{m,n}(s)}{B_{m,n}(s)}=G(s)=\frac{u_0}{s+H(t)+\kappa\lambda_{m,n}} \tag{54}$$

so that $$q_{m,n}(t)=|G(j\omega_1)|\frac{2}{L_xL_y}\cos[\omega_1t+\angle G(j\omega_1)]+|G(j\omega_2)|\frac{2}{L_xL_y}\cos[\omega_2t+\angle G(j\omega_2)] \tag{55}$$

where $$|G(j\omega)|=\frac{u_0}{\sqrt{\omega^2+[H(t)+\kappa\lambda_{m,n}]^2}} \tag{56}$$

$$\angle G(j\omega)=-\arctan\left(\frac{\omega}{H(t)+\kappa\lambda_{m,n}}\right) \tag{57}$$

giving $$q_{m,n}(t) = \frac{2}{L_x L_y} \frac{u_0}{\sqrt{\left(\frac{m\pi\upsilon_x}{L_x} + \frac{n\pi\upsilon_y}{L_y}\right)^2 + [H(t) + \kappa\lambda_{m,n}]^2}} \cos\left[\left(\frac{m\pi\upsilon_x}{L_x} + \frac{n\pi\upsilon_y}{L_y}\right)t - \arctan\left(\frac{m\pi\upsilon_x L_y + n\pi\upsilon_y L_x}{H(t)L_x L_y + \kappa\lambda_{m,n} L_x L_y}\right)\right] + \frac{2}{L_x L_y} \frac{u_0}{\sqrt{\left(\frac{m\pi\upsilon_x}{L_x} - \frac{n\pi\upsilon_y}{L_y}\right)^2 + [H(t) + \kappa\lambda_{m,n}]^2}} \cos\left[\left(\frac{m\pi\upsilon_z}{L_x} - \frac{n\pi\upsilon_y}{L_y}\right)t - \arctan\left(\frac{m\pi\upsilon_x L_y - n\pi\upsilon_y L_x}{H(t)L_x L_y + \kappa\lambda_{m,n} L_x L_y}\right)\right] \tag{58}$$

General Heat Sources

The analysis above assumes that the surface is heated by a source which has a spatial profile consisting of an impulse function, δ(x, y). This is a specific case of the more general 2D heat source $\tilde{f}(x, y, t)$. In the general case, with the heat source moving with velocity ν and angle ψ over the surface, $$\frac{\partial\theta}{\partial t} = \kappa\nabla^2\theta - H(t)\theta + \tilde{f}(x - \upsilon_x t,\ y - \upsilon_y t)u(t) + p(t) \tag{59}$$

and the coefficients, $q_{m,n}(t)$, have the solution $$\dot{q}_{m,n}(t) = -[H(t) + \kappa\lambda_{m,n}](t) + \tilde{b}_{m,n}(t)\upsilon_0 \tag{60}$$

where, $$\tilde{b}_{m,n}(t) = \frac{4}{L_x L_y}\int_0^{L_y}\int_0^{L_x} \tilde{f}(x - \upsilon_x t,\ y - \upsilon_y t)\cos\left(\frac{m\pi x}{L_x}\right)\cos\left(\frac{n\pi y}{L_y}\right)dx\,dy \tag{61}$$

Applying a change of variables, $x' = x - \nu_x t$, $y' = \nu_y t$ $$\tilde{b}_{m,n}(t) = \frac{4}{L_x L_y}\int_{-\upsilon_y t}^{L_y - \upsilon_y t}\int_{-\upsilon_x t}^{L_x - \upsilon_x t} \tilde{f}(x', y')\cos\left(\frac{m\pi(x' + \upsilon_x t)}{L_x}\right)\cos\left(\frac{n\pi(y' + \upsilon_y t)}{L_y}\right)dx'\,dy' \tag{62}$$

Using cos(A+B)=cos A cos B−sin A sin B $$\tilde{b}_{m,n}(t) = \frac{4}{L_x L_y}\cos\left(\frac{m\pi\upsilon_x t}{L_x}\right)\cos\left(\frac{n\pi\upsilon_y t}{L_y}\right) \int_{-\upsilon_y t}^{L_y - \upsilon_y t}\int_{-\upsilon_x t}^{L_x - \upsilon_x t} \tilde{f}(x', y')\cos\left(\frac{m\pi x'}{L_x}\right)\cos\left(\frac{n\pi y'}{L_y}\right)dx'\,dy' - \frac{4}{L_x L_y}\cos\left(\frac{m\pi\upsilon_x t}{L_x}\right)\sin\left(\frac{n\pi\upsilon_y t}{L_y}\right) \int_{-\upsilon_y t}^{L_y - \upsilon_y t}\int_{-\upsilon_x t}^{L_x - \upsilon_x t} \tilde{f}(x', y')\cos\left(\frac{m\pi x'}{L_x}\right)\sin\left(\frac{n\pi y'}{L_y}\right)dx'\,dy' - \frac{4}{L_x L_y}\sin\left(\frac{m\pi\upsilon_x t}{L_x}\right)\cos\left(\frac{n\pi\upsilon_y t}{L_y}\right) \tag{63}$$

-continued $$\int_{-\upsilon_y t}^{L_y - \upsilon_y t}\int_{-\upsilon_x t}^{L_x - \upsilon_x t} \tilde{f}(x', y')\sin\left(\frac{m\pi x'}{L_x}\right)\cos\left(\frac{n\pi y'}{L_y}\right)dx'\,dy' + \frac{4}{L_x L_y}\sin\left(\frac{m\pi\upsilon_x t}{L_x}\right)\sin\left(\frac{n\pi\upsilon_y t}{L_y}\right) \int_{-\upsilon_y t}^{L_y - \upsilon_y t}\int_{-\upsilon_x t}^{L_x - \upsilon_x t} \tilde{f}(x', y')\sin\left(\frac{m\pi x'}{L_x}\right)\sin\left(\frac{n\pi y'}{L_y}\right)dx'\,dy'$$

If the spatial range of the heat source is limited, so that $\tilde{f}(x', y') = 0$ for $|x'| > \gamma_x$ and for $|y'| > \gamma_y$, then the limits of the integrations in (63) can be truncated. In addition, if $\tilde{f}(x', y')$ is an even function with respect to both x' and y', then only the integrand in the first integral is also even. The other three integrands are odd functions and will therefore integrate to zero provided that $-\nu_x t \leqq -\gamma_x$, $L_x - \nu_x t \geqq \gamma_x$, $-\nu_y t \leqq -\gamma_y$ and $L_y - \nu_y t \geqq \gamma_y$. Clearly this will not be the case when the heat source is close to the edges of the surface, so an error will be introduced. If $L_x \gg \gamma_x$ and $L_y \gg \gamma_y$ this error will be small and will be ignored in the rest of the analysis.

Equation (63) reduces to $$\tilde{b}_{m,n}(t) = \tilde{b}_{m,n}\frac{4}{L_x L_y}\cos\left(\frac{m\pi\upsilon_x t}{L_x}\right)\cos\left(\frac{n\pi\upsilon_y t}{L_y}\right) \tag{64}$$

where $\tilde{b}_{m,n}$ is obtained from the expansion of the spatial footprint of the gun when it is positioned in the centre of the surface, so that the region where $\tilde{f}(x, y, t) \neq 0$ does not extend beyond the edges of the surface. The gun will be at the centre of the surface when $\nu_x t = L_x/2$ and $\nu_y t = L_y/2$, so that $$\tilde{b}_{m,n} = \int_{-L_y/2}^{L_y/2}\int_{-L_x/2}^{L_x/2} \tilde{f}(x', y')\cos\left(\frac{m\pi x'}{L_x}\right)\cos\left(\frac{n\pi y'}{L_y}\right)dx'\,dy' \tag{65}$$

This shows that for a general heat source, $\tilde{f}(x, y, t)$, the coefficients associated with each mode, $q_{m,n}(t)$ for a general heat source reduce to the solution for an impulsive heat source multiplied by $\tilde{b}_{m,n}$ $$q_{m,n}(t) = \frac{2}{L_x L_y} \frac{\tilde{b}_{m,n} u_0}{\sqrt{\left(\frac{m\pi\upsilon_x}{L_x} + \frac{n\pi\upsilon_y}{L_y}\right)^2 + [H(t) + \kappa\lambda_{m,n}]^2}} \cos\left[\left(\frac{m\pi\upsilon_x}{L_x} + \frac{n\pi\upsilon_y}{L_y}\right)t - \arctan\left(\frac{m\pi\upsilon_x L_y + n\pi\upsilon_y L_x}{H(t)L_x L_y + \kappa\lambda_{m,n} L_x L_y}\right)\right] + \frac{2}{L_x L_y} \frac{\tilde{b}_{m,n} u_0}{\sqrt{\left(\frac{m\pi\upsilon_x}{L_x} - \frac{n\pi\upsilon_y}{L_y}\right)^2 + [H(t) + \kappa\lambda_{m,n}]^2}} \cos\left[\left(\frac{m\pi\upsilon_z}{L_x} - \frac{n\pi\upsilon_y}{L_y}\right)t - \arctan\left(\frac{m\pi\upsilon_x L_y - n\pi\upsilon_y L_x}{H(t)L_x L_y + \kappa\lambda_{m,n} L_x L_y}\right)\right] \tag{66}$$

where $$\lambda_{m,n} = \frac{m^2\pi^2}{L_x^2} + \frac{n^2\pi^2}{L_y^2} \tag{67}$$

Choosing the Optimal Path

Optimisation Criteria

The thermal profile over the surface is $$\theta(x, y, t) = \sum_{m=0}^{\infty}\sum_{n=0}^{\infty} q_{m,n}(t)\phi_{m,n}(x, y) \tag{68}$$

where $q_{m,n}(t)$ are given in (66) and from (35), the spatial eigenfunctions, are $$\phi_{m,n}(x, y) = \cos\left(\frac{m\pi}{L_x}x\right)\cos\left(\frac{n\pi}{L_y}y\right) \tag{69}$$

The deviation from the average temperature is given by $$\theta(x, y, t)-\theta(t) \tag{70}$$

where $$\tilde{\theta}(t) = \frac{1}{L_xL_y}\int_0^{L_y}\int_0^{L_y}\theta(x, y, t)dxdy \tag{71}$$

$$= \sum_{m=0}^{\infty}\sum_{n=0}^{\infty} q_{m,n}(t)\frac{1}{L_xL_y}\int_0^{L_y}\int_0^{L_y}\cos\left(\frac{m\pi}{L_x}x\right)\cos\left(\frac{n\pi}{L_y}y\right)dxdy \tag{72}$$

$$= q_{0,0}(t) \tag{73}$$

since $\phi_{0,0}(x, y)=1$. Hence, the deviation in the temperature profile is obtained by removing the 0, 0 term from the summations in (68)

$$\theta(x, y, t) - \tilde{\theta}(t) = \sum_{m=1}^{\infty}\sum_{n=1}^{\infty} q_{m,n}(t)\phi_{m,n}(x, y) \tag{74}$$

This justifies excluding the p(t) term in (42) as it only affects the $q_{0,0}(t)$ term which does not contribute to the deviation from the average temperature.

The aim is to choose a path for the spray gun that minimises (in some sense), the deviation. There are a number of approaches to minimising the deviation in temperature, but three appropriate choices are considered here Maximum Deviation At any time, t, the maximum value of the temperature deviation over the surface is given by $$\left|\theta(x, y, t) - \tilde{\theta}(t)\right| = \left|\sum_{m=1}^{\infty}\sum_{n=1}^{\infty} q_{m,n}(t)\phi_{m,n}(x, y)\right| \tag{75}$$

$$\leq \sum_{m=1}^{\infty}\sum_{n=1}^{\infty}|q_{m,n}(t)\phi_{m,n}(x, y)| \tag{76}$$

$$\leq \sum_{m=1}^{\infty}\sum_{n=1}^{\infty}|q_{m,n}(t)| \tag{77}$$

where (77) follows because the maximum value of $\phi_{m,n}(x, y)$ over the surface is unity for all spatial eigenvalues. The peak value of $|q_{m,n}(t)|$ will occur at times when the two cosine components in (66) interfere constructively, so that $$|q_{m,n}|_{peak} = \frac{2}{L_xL_y}\left[\frac{\hat{b}_{m,n}u_0}{\sqrt{\left(\frac{m\pi\upsilon_x}{L_x}+\frac{n\pi\upsilon_y}{L_y}\right)^2+[H(t)+\kappa\lambda_{m,n}]^2}} + \frac{\hat{b}_{m,n}u_0}{\sqrt{\left(\frac{m\pi\upsilon_x}{L_x}-\frac{n\pi\upsilon_y}{L_y}\right)^2+[H(t)+\kappa\lambda_{m,n}]^2}}\right] \tag{78}$$

The overall deviation in temperature is minimsed by minimising the maximum peak value, $|q_{m,n}|_{peak}$, for {m=1,2, . . . ,n=1,2, . . . }.

Thermal Gradient The gradient of the temperature deviation in the x-direction is $$\frac{\partial\theta}{\partial x} = \sum_{m=1}^{\infty}\sum_{n=1}^{\infty} q_{m,n}(t)\frac{\partial\phi_{m,n}}{\partial x} \tag{79}$$

$$= -\sum_{m=1}^{\infty}\sum_{n=1}^{\infty}\frac{m\pi}{L_x}q_{m,n}(t)\phi_{m,n}(x, y) \tag{80}$$

Hence the magnitude of the thermal gradient in the x-direction can be minimised by minimising the maximum value of $$\left|\frac{m\pi}{L_x}q_{m,n}\right|_{peak} = \frac{m\pi}{L_x}\frac{2}{L_xL_y}\left[\frac{\hat{b}_{m,n}u_0}{\sqrt{\left(\frac{m\pi\upsilon_x}{L_x}+\frac{n\pi\upsilon_y}{L_y}\right)^2+[H(t)+\kappa\lambda_{m,n}]^2}} + \frac{\hat{b}_{m,n}u_0}{\sqrt{\left(\frac{m\pi\upsilon_x}{L_x}-\frac{n\pi\upsilon_y}{L_y}\right)^2+[H(t)+\kappa\lambda_{m,n}]^2}}\right] \tag{81}$$

This criterion is similar to minimising the deviation, but more "weight" is applied to the magnitude of the higher order modes, which generate larger thermal gradients. The magnitude of the thermal gradient in the y-direction is minimised by minimising the maximum value of $$\left|\frac{m\pi}{L_x}q_{m,n}\right|_{peak} = \frac{n\pi}{L_y}\frac{2}{L_xL_y}\left[\frac{\hat{b}_{m,n}u_0}{\sqrt{\left(\frac{m\pi\upsilon_x}{L_x}+\frac{n\pi\upsilon_y}{L_y}\right)^2+[H(t)+\kappa\lambda_{m,n}]^2}} + \frac{\hat{b}_{m,n}u_0}{\sqrt{\left(\frac{m\pi\upsilon_x}{L_x}-\frac{n\pi\upsilon_y}{L_y}\right)^2+[H(t)+\kappa\lambda_{m,n}]^2}}\right] \tag{82}$$

Mean Square Deviation The mean square deviation (or variance) of the thermal profile over the surface is $$\frac{1}{L_xL_y}\int_0^{L_y}\int_0^{L_x}\left[\theta(x, y, t) - \tilde{\theta}(t)\right]^2 dxdy = \tag{83}$$

-continued $$\frac{1}{L_x L_y}\int_0^{L_y}\int_0^{L_x}\left[\sum_{m=1}^{\infty}\sum_{n=1}^{\infty} q_{m,n}(t)\phi_{m,n}(x, y)\right]^2 dx dy$$

By the orthogonality properties of the spatial eigenfunctions, $\phi_{m,n}(x, y)$, this reduces to $$\frac{1}{L_x L_y}\int_0^{L_y}\int_0^{L_x}\left[\theta(x, y, t) - \tilde{\theta}(t)\right]^2 dx dy = \sum_{m=1}^{\infty}\sum_{n=1}^{\infty}[q_{m,n}(t)]^2 \tag{84}$$

where $q_{m,n}(t)$ is given in (66). It this mean square deviation is averaged over time, $$\lim_{T\to\infty}\frac{1}{T}\int_0^T\sum_{m=1}^{\infty}\sum_{n=1}^{\infty}|q_{m,n}(t)]^2 dt = \sum_{m=1}^{\infty}\sum_{n=1}^{\infty}\lim_{t\to\infty}\frac{1}{T}\int_0^T|q_{m,n}(t)]^2 dt = \tag{85}$$

$$\sum_{m=1}^{\infty}\sum_{n=1}^{\infty}\frac{1}{L_x L_y}\left[\frac{\hat{b}_{m,n}^2 u_0^2}{\left(\frac{m\pi\upsilon_x}{L_x}+\frac{n\pi\upsilon_y}{L_y}\right)^2+[H(t)+\kappa\lambda_{m,n}]^2}+\frac{\hat{b}_{m,n}^2 u_0^2}{\left(\frac{m\pi\upsilon_x}{L_x}-\frac{n\pi\upsilon_y}{L_y}\right)^2+[H(t)+\kappa\lambda_{m,n}]^2}\right] \tag{86}$$

Effect of Changing Path on Thermal Profile

For each of the criteria listed above, the magnitude of the criteria are determined by the maximum amplitude of the oscillations in $q_{m,n}(t)$ for each mode $$|q_{m,n}|_{peak} = \frac{2}{L_x L_y}\left[\frac{\hat{b}_{m,n}u_0}{\sqrt{\left(\frac{m\pi\upsilon_x}{L_x}+\frac{n\pi\upsilon_y}{L_y}\right)^2+[H(t)+\kappa\lambda_{m,n}]^2}}+\frac{\hat{b}_{m,n}u_0}{\sqrt{\left(\frac{m\pi\upsilon_x}{L_x}-\frac{n\pi\upsilon_y}{L_y}\right)^2+[H(t)+\kappa\lambda_{m,n}]^2}}\right] \tag{87}$$

Figure 3:
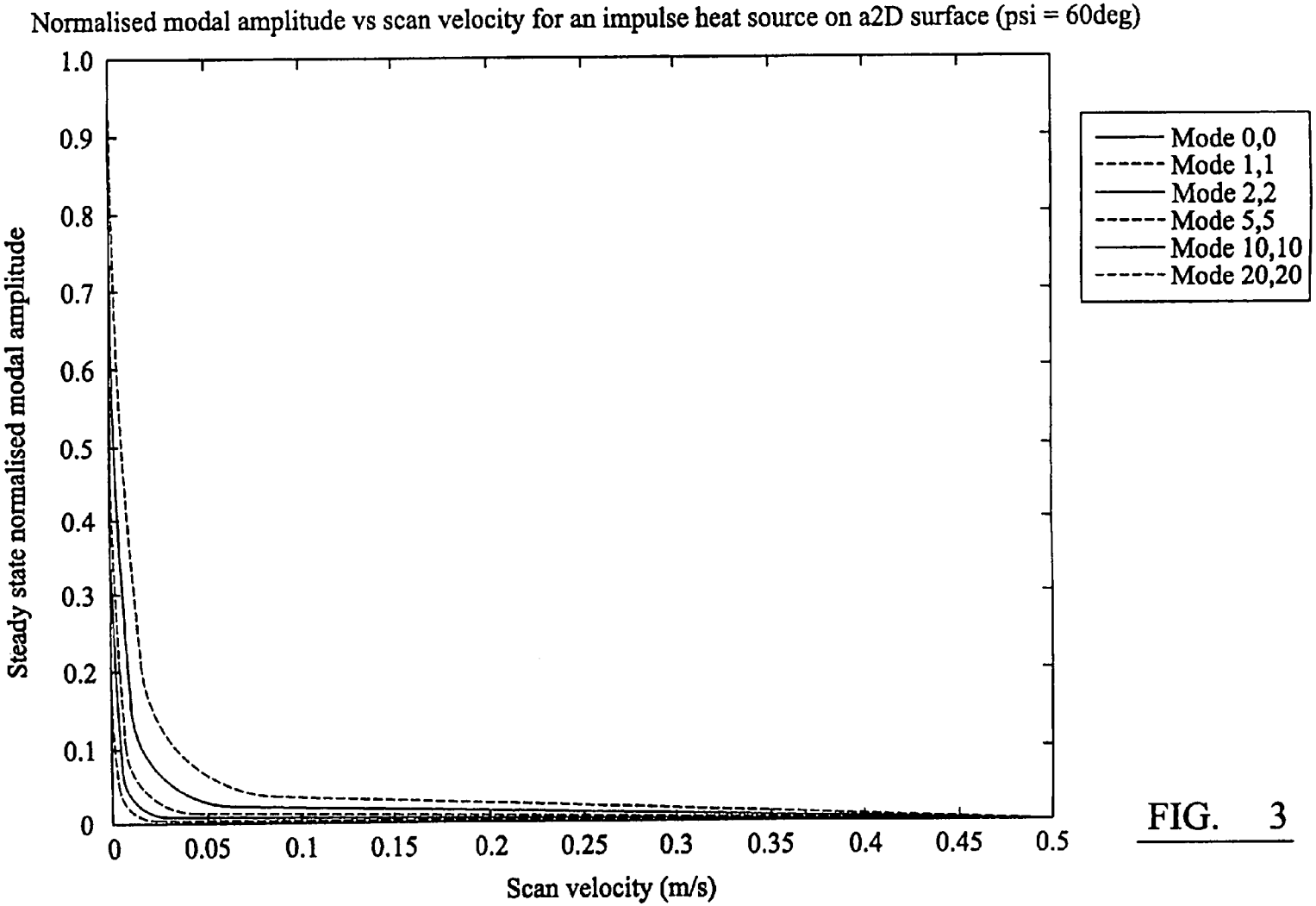
FIG. 3 shows normalised peak amplitude of different spatial modes plotted against scan velocity.

When choosing a regular scanning path, there are two degrees of freedom for adjusting the magnitude of each mode:

Scan velocity, ν. Prom equation (87), it can be seen that increasing the velocity, ν, reduces the magnitude of all modes and there is an approximately inverse relationship between the amplitude of $q_{m,n}(t)$ and scan velocity, as shown in FIG. 3, which plots the amplitude of different spatial modes against scan velocity, ν. As a result, to achieve a "flat" temperature profile, the scan velocity should be as fast as possible.

Figure 4:
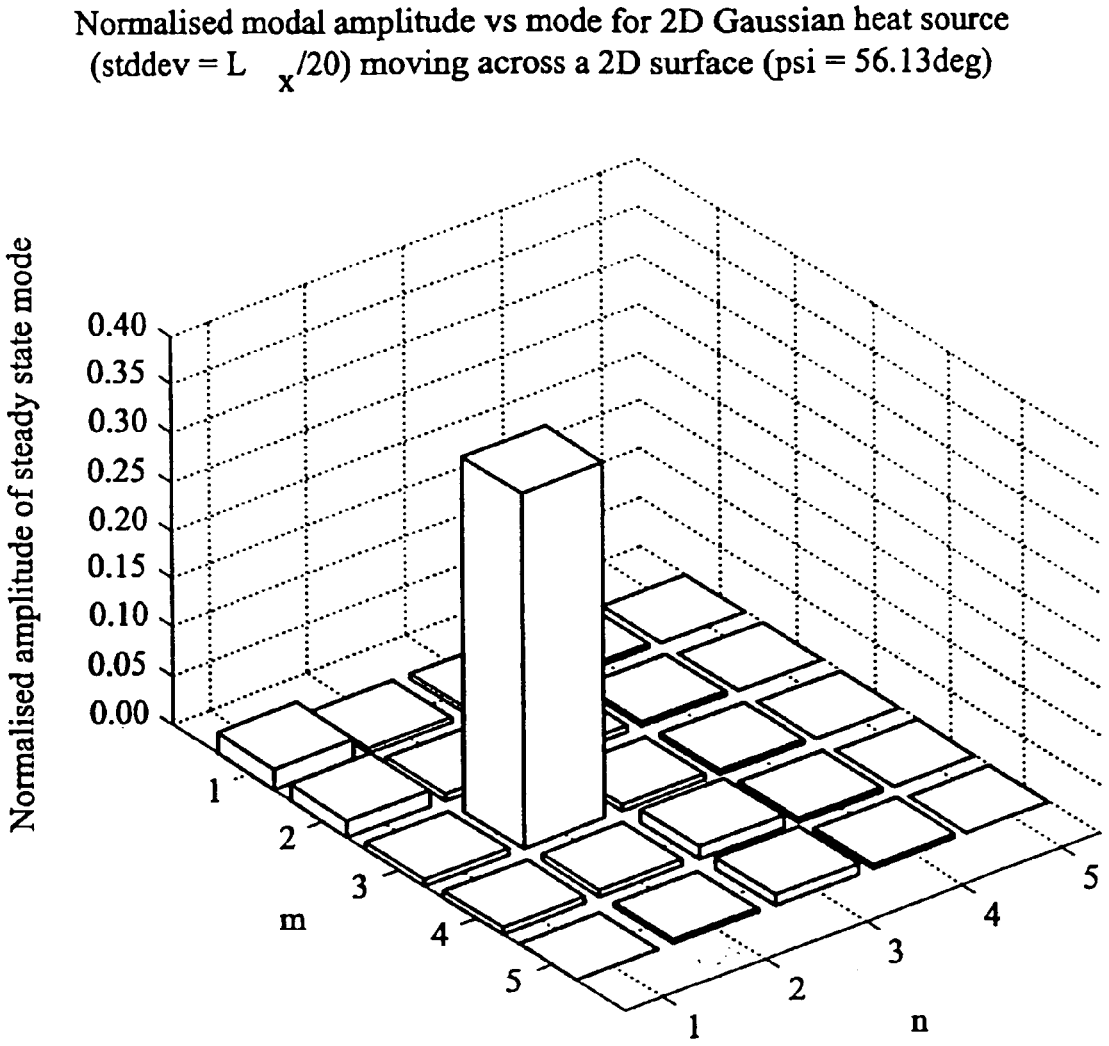
FIG. 4 shows normalised peak amplitude of different modes for a Gaussian footprint of width $L_x/20$ and scan angle ψ=56.13°.
Figure 5:
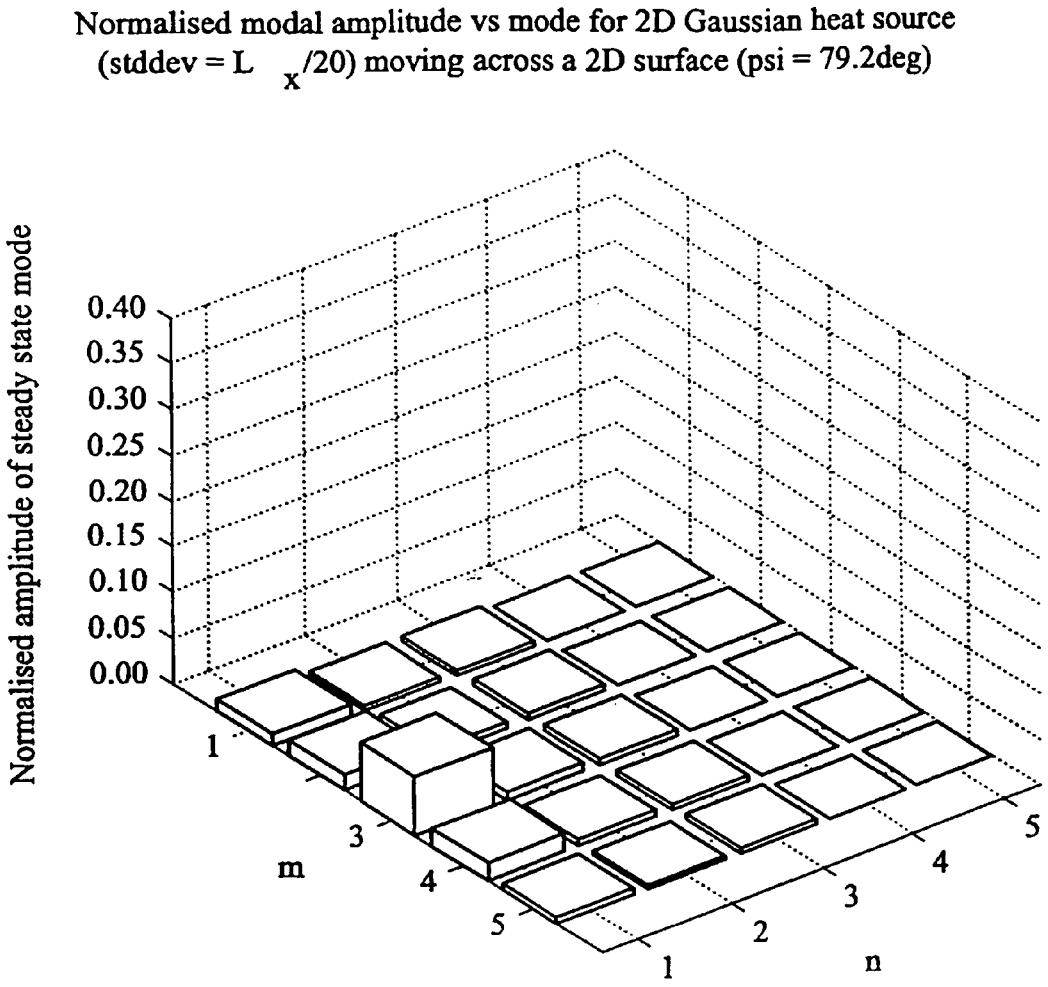
FIG. 5 shows normalised peak amplitude of different modes for a Gaussian footprint of width $L_x/20$ and scan angle ψ=72.9°.

Scan angle, ψ. The relationship between the amplitude of $q_{m,n}(t)$ and the scan angle is more complicated. The first term inside the square brackets is large when m and n, and consequently, $\lambda_{m,n}$, are small. The second term is maximised when $$\frac{m\pi\upsilon\cos\psi}{L_x}+\frac{n\pi\upsilon\sin\psi}{L_y} \tag{88}$$

or $$\tan\psi = \frac{mL_y}{nL_x} \tag{89}$$

so that the first term under the square root in the denominator becomes zero. This is illustrated in FIG. 4 which shows the relative magnitude of the different modes when $\tilde{f}(x, y, t)$ is a 2-dimensional Gaussian function with circular symmetry of width $L_x/20$. For a square surface, so that $L_x=L_y$, when the scan angle is 56.13°, tan ψ=3/2 and the plot shows that the $q_{3,2}(t)$ mode has the maximum amplitude. As a result, this scanning pattern will result in a poor thermal profile. By contrast, for the path shown in FIG. 5, ψ=72.9°, so that tan ψ=3.25, then the relative magnitude of the modes is much lower. The mode with the largest amplitude on the plot is $q_{3,1}(t)$ as this is closest to tan ψ. Since tan ψ=13/4, it might be expected that $q_{13,4}(t)$ would have the largest amplitude, but the presence of the $m^2$ and $n^2$ terms in $$\lambda_{m,n} = \pi^2\upsilon^2\left(\frac{m^2\cos^2\psi}{L_x^2}+\frac{n^2\sin^2\psi}{L_y^2}\right) \tag{90}$$

which is also under the square root in the denominator, reduces the amplitude of this mode. In addition, if $\tilde{f}(x, y, t)$ is smooth, so that $|\bar{b}_{m,n}|\to 0$ as m and n become large and $\bar{b}_{13,4}$ is likely to be small.

Figure 6:
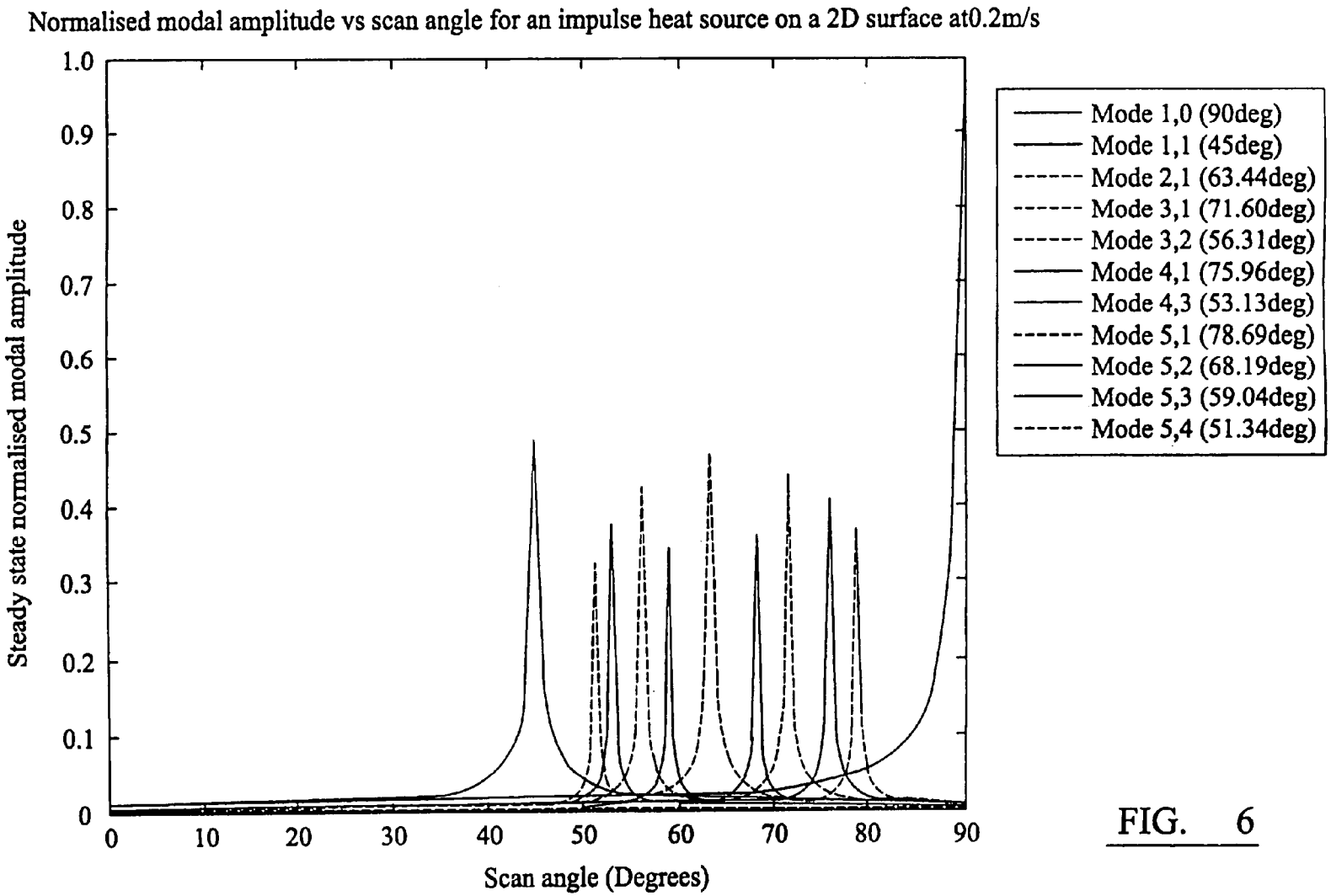
FIG. 6 shows normalised peak amplitude of different modes plotted against scan angle for an impulsive footprint when the gun velocity is 0.2 m $s^{-1}$. The legend shows the angle at which the peak amplitude occurs for each mode.
Figure 7:
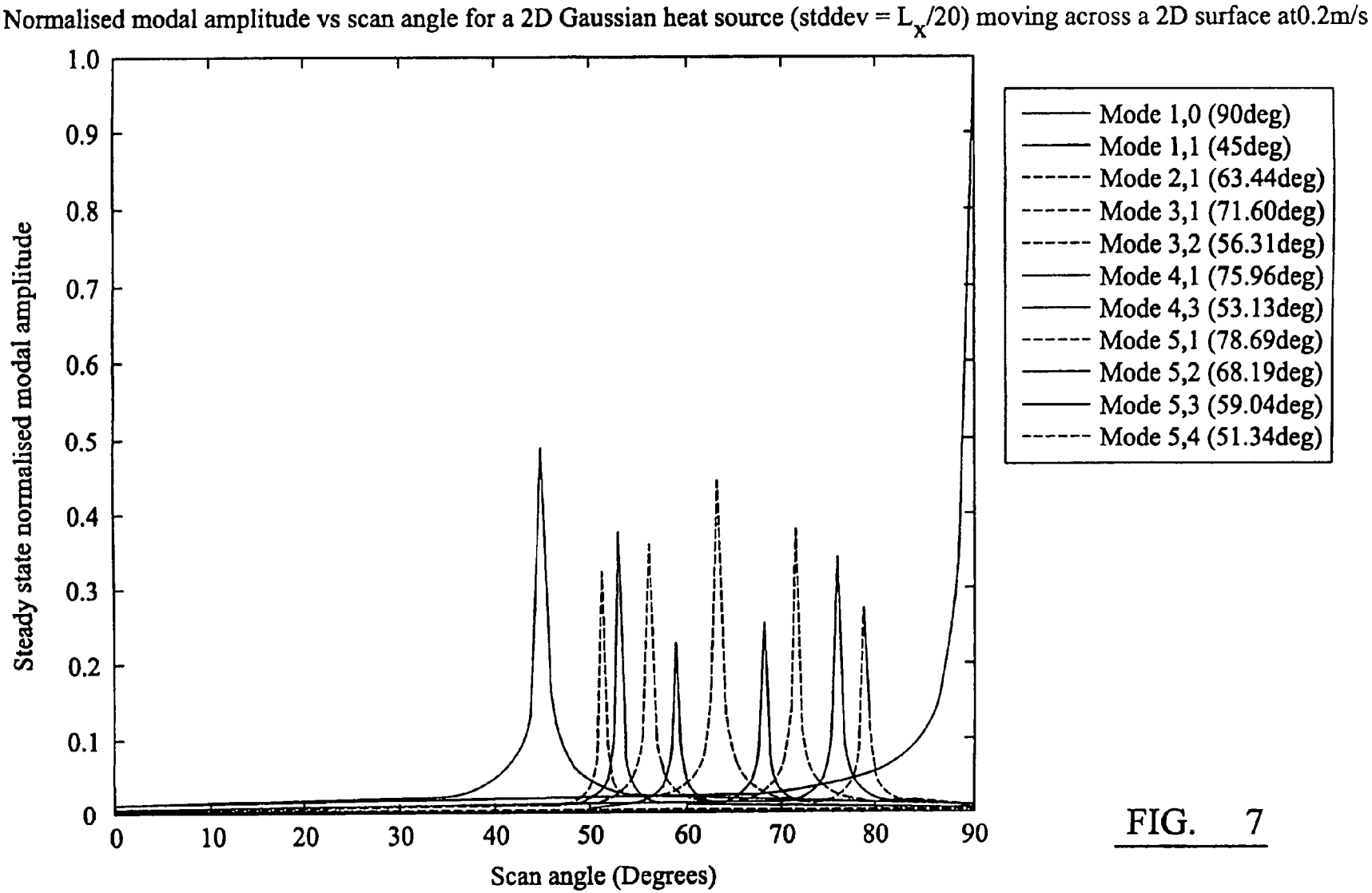
FIG. 7 shows normalised peak amplitude of different modes plotted against scan angle for a Gaussian footprint of width $L_x/20$ when the gun velocity is 0.2 m $s^{-1}$. The legend shows the angle at which the peak amplitude occurs for each mode.
Figure 8:
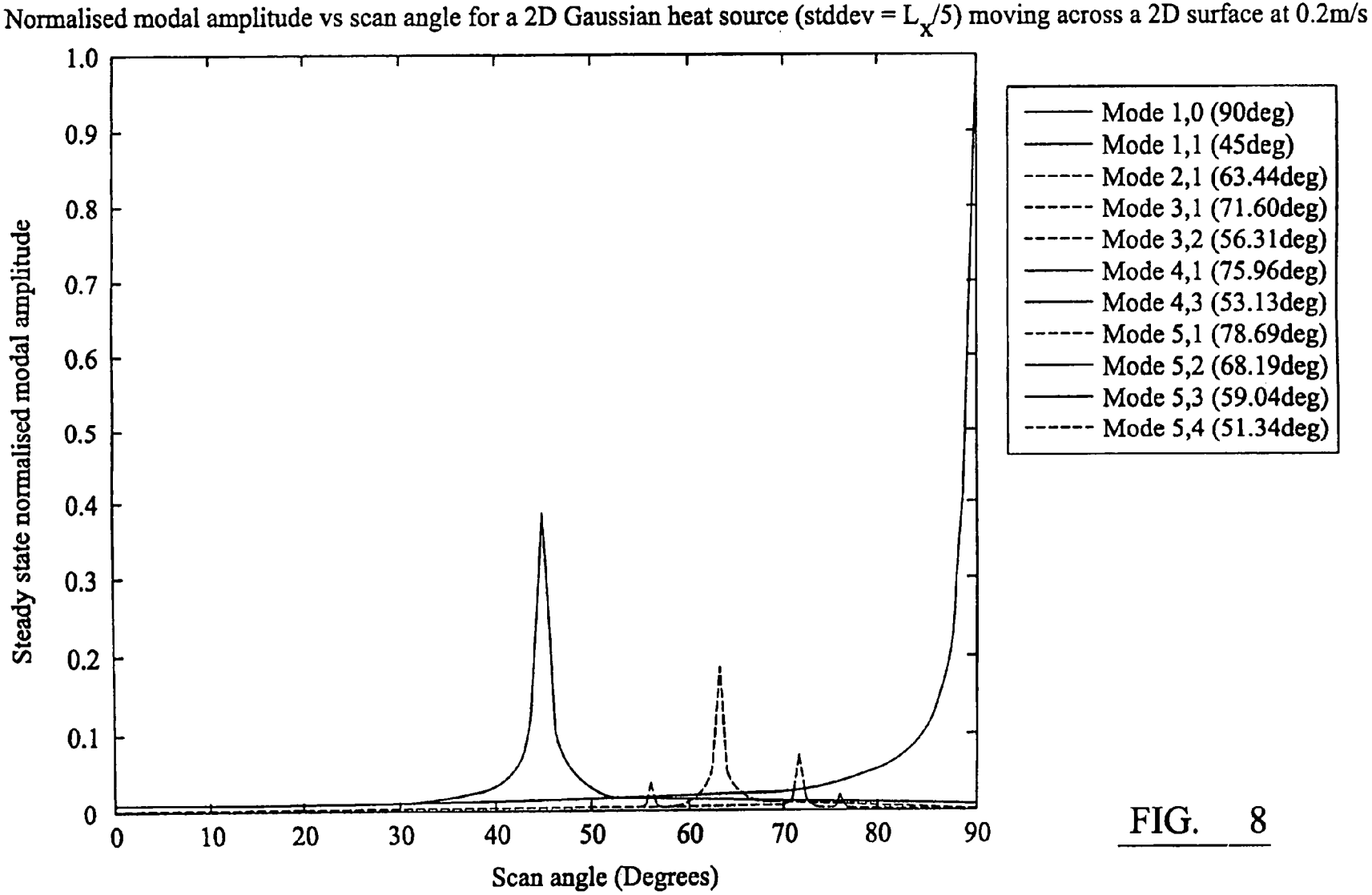
FIG. 8 shows normalised peak amplitude of different modes plotted against scan angle for a Gaussian footprint of width $L_x/5$ when the gun velocity is 0.2 m $s^{-1}$. The legend shows the angle at which the peak amplitude occurs for each mode.

The effect of the shape of the footprint is illustrated in FIGS. 6, 7 and 8. FIG. 6 shows the relative magnitude of various modes, $q_{m,n}(t)$ for m≧n plotted against scan angle, ψ, for a square surface, when $\tilde{f}(x, y, t)$ is a delta function (the plot for m≦n is the mirror image around ψ=45°). The angles at which each mode is a maximum are shown in the legend to the figure. FIG. 7 shows the magnitude of the corresponding modes when $\tilde{f}(x, y, t)$ is a narrow 2-dimensional Caussian function of width (standard deviation) $L_x/20$. Because this is smoother than a delta function, the magnitude of the modes are lower than the corresponding modes for the delta function. FIG. 8 shows the magnitude of the modes for a wide 2-dimensional Gaussian function of width $L_x/5$ and for this case, the magnitude of all modes is much lower, indicating that in order to avoid large deviations in the thermal profile, the "footprint" of the gun should be as wide as possible.

Determining the Path

This analysis indicates that the thermal profile will be minimised by choosing a scan angle such that $$\tan\psi \neq \frac{mL_y}{nL_x} \tag{91}$$

Figure 9:
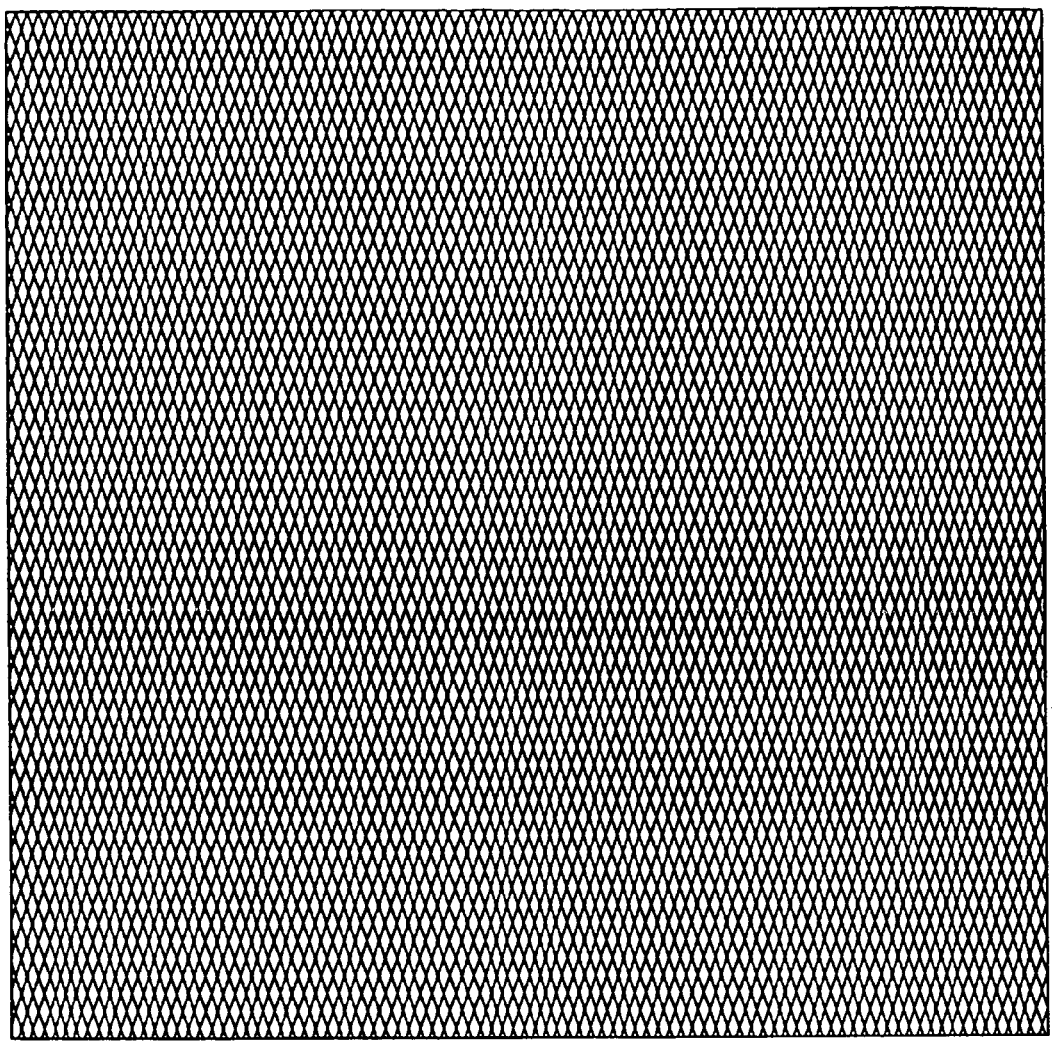
FIG. 9 is a schematic representation of an exemplary path that results in a good thermal profile, but does not repeat.
Figure 10:
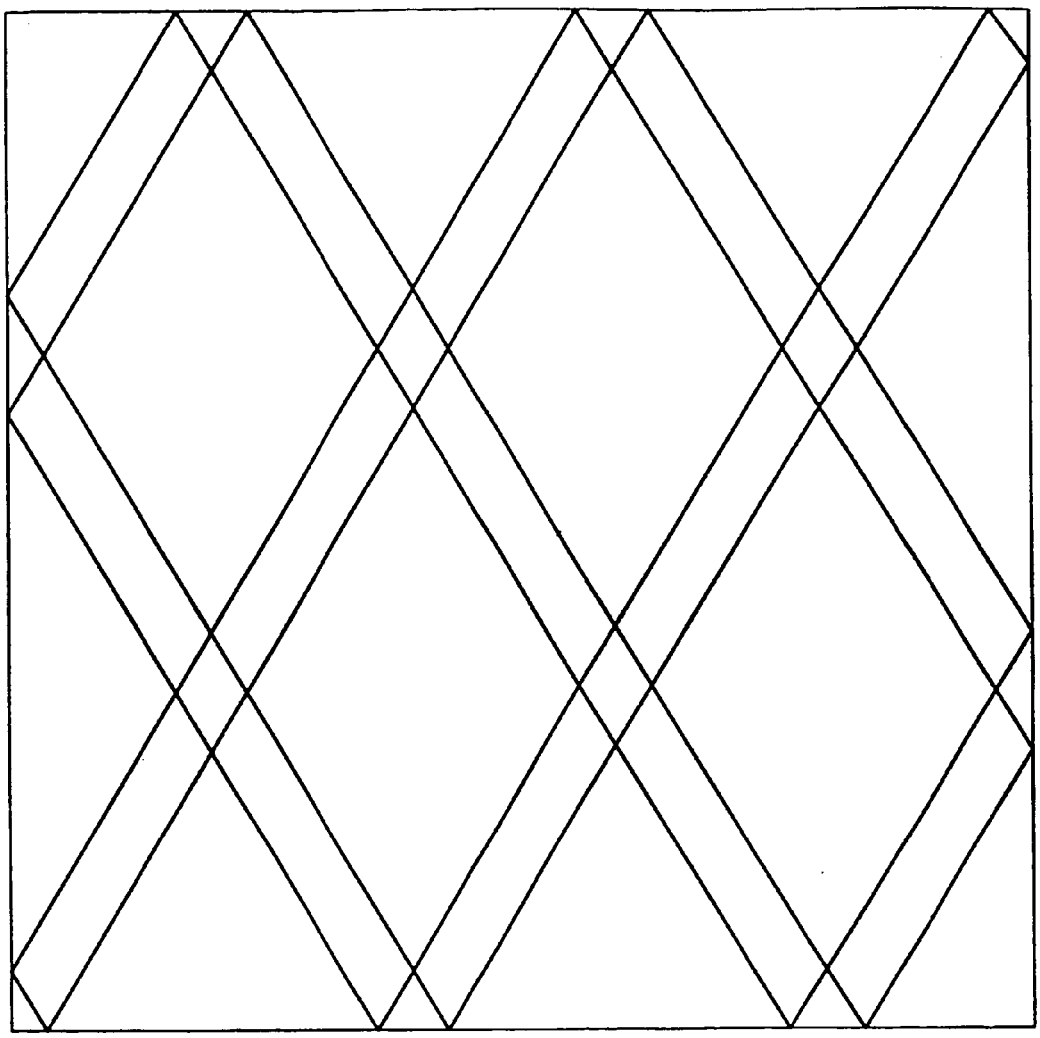
FIG. 10 is a schematic representation of an exemplary poor path that amplifies a particular mode, in this case $q_{5,3}(t)$.
Figure 11:
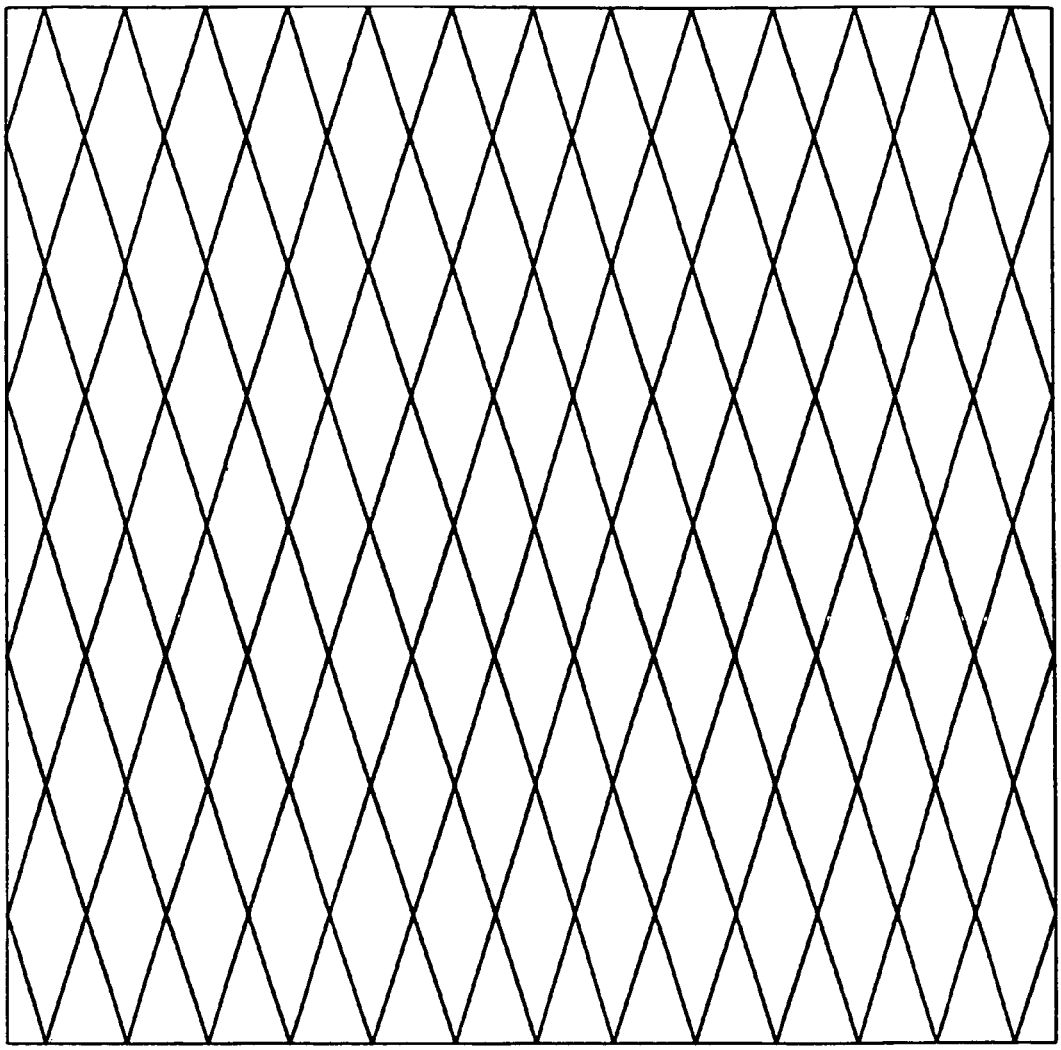
FIG. 11 is a schematic representation of an exemplary closed path that avoids amplifying low order modes and results in a flat thermal profile.

One such example is given in FIG. 9, which shows the pattern generated when ψ=73.5° for $L_x=L_y$, so that tan ψ=3.37. This path generates a "flat" thermal profile, but it is difficult to program-the-path into the robot as it never repeats itself, leading to a robot program that (theoretically) consists of an infinite number of points. For ease of robot path programming, if the robot is started at a point on one edge of the surface, it should return to this point after a finite, manageable number of passes over the surface. Unfortunately, the condition on the scan angle to ensure that this occurs is that $$\tan\psi = \frac{\mu L_y}{\upsilon L_x} \tag{92}$$

where μ and ν are integers, which is exactly the same as the condition for exciting the thermal modes. Thus, the requirement for a closed path is in direct contradiction to the requirement for a flat thermal profile. This is illustrated in FIG. 10, which shows a path that repeats itself, but it also excites the $q_{5,3}(t)$ mode, resulting in a poor thermal profile. However, by choosing a scan angle as in FIG. 11 that satisfies the criterion in (92) but making sure that μ and ν are sufficiently large so that $|q_{\mu,\nu}|_{peak}$ is small (because $\lambda_{\mu,\nu}$ is large and $b_{\mu,\nu}$ is small) then a good thermal profile is achieved using a repeating scan pattern. It is important to ensure that μ and ν have no common factors to avoid exciting lower order modes: for example, if μ=12 and ν=6, although the magnitude of $q_{12,6}(t)$ may be relatively small, this path will also excite $q_{2,1}(t)$ which will be much larger.

Having chosen a scan angle, one final check that needs to be carried out is to ensure that the maximum distance between scans in the same direction satisfies the condition for uniform mass deposition. For a spray footprint with 2-dimensional Gaussian shape, this is equivalent to requiring the that distance between the scans should be less than πσ/3, where σ is the width (standard deviation) of the Gaussian [1].

Figure 12:
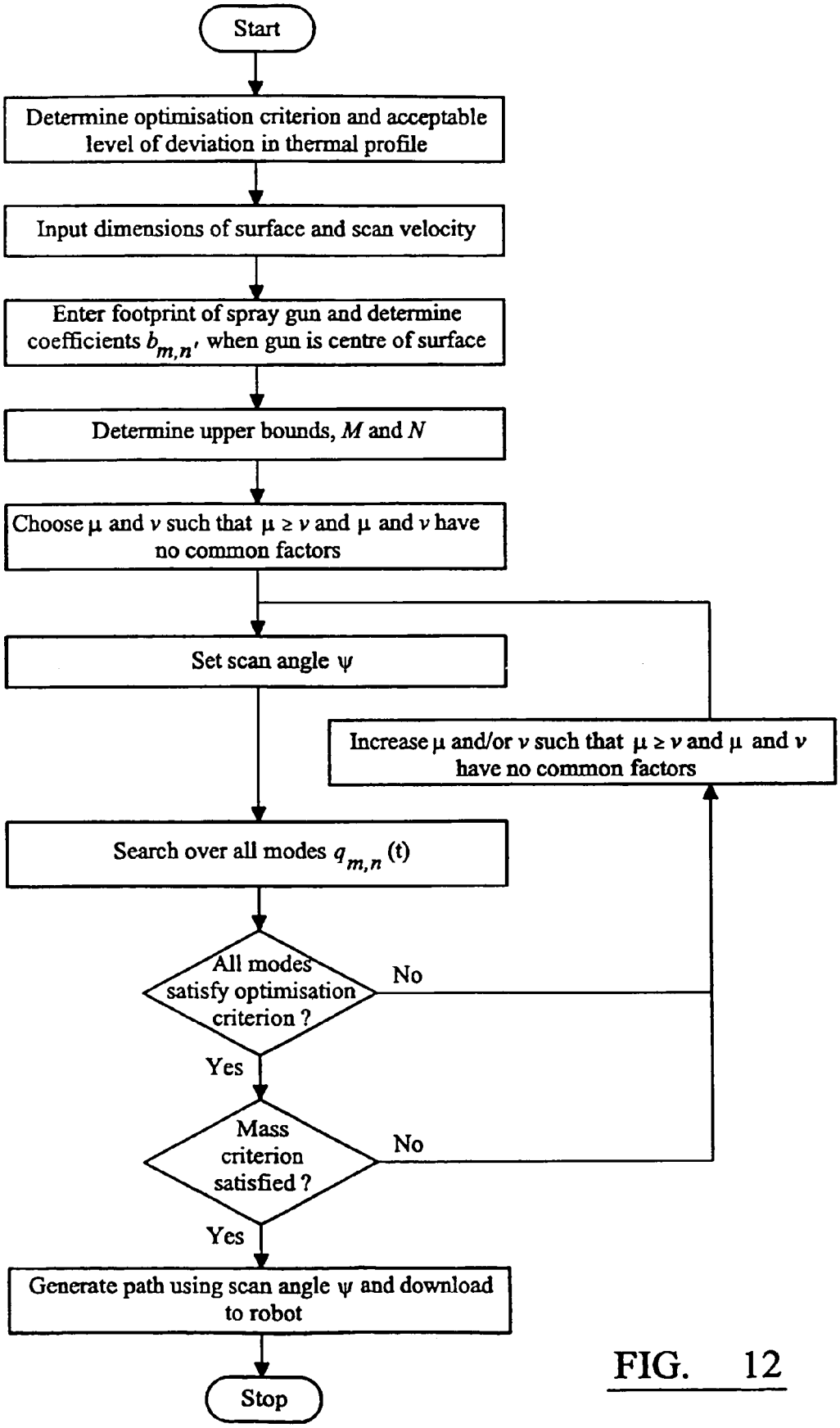
FIG. 12 is a flowchart for optimisation procedure in accordance with the invention.

This leads to the procedure shown in FIG. 12 for determining the optimal path.

1. Choose optimisation criterion and maximum acceptable level of deviation from the desired thermal profile.
2. Input the dimensions of the surface, $L_x$, $L_y$ and the scan velocity, ν.
3. Enter the footprint of the spray gun, $\mathfrak{f}(x, y, t)$ and determine the coefficients, $\mathfrak{b}_{m,n}$ when the gun is centre of the surface, using (65).
4. Determine upper bounds, M and N, such that $\{\mathfrak{b}_{m,n}\approx 0: m>M; n>N\}$
5. Choose integers, μ and ν, such that μ≧ν and μ and ν have no common factors.
6. Set scan angle to $$\tan\psi = \frac{\mu L_y}{\upsilon L_x} \tag{93}$$

7. Search over all modes, {m=1,2, . . . , M,n=1,2, . . . , N}, to ensure that all $q_{m,n}(t)$ satisfy the optimisation criterion for this scan angle.
8. If the criterion is not satisfied, increase ν and/or μ and repeat from step 5.
9. If the criterion is satisfied, check that path satisfies mass deposition criterion
10. If the mass deposition criterion is not satisfied, increase ν and/or p and repeat from step 5
11. If the mass deposition criterion is satisfied, use scan angle, ψ, to generate robot path and download to robot.
12. Stop.

If it is not possible to find a scan angle that satisfies the optimisation criterion, then the scan velocity and/or the width of the spray footprint need to be increased until the procedure can find an suitable path.

It should be noted that because H(t) arid $\mathfrak{f}(x, y, t)$ depend upon z(t), their values will change as the thickness of the steel shell builds up. As a result, the optimal path may change as z(t) increases and it may be necessary to perform the optimisation at a range of different thicknesses.

Extensions to Other Geometries

The process described above is based upon the assumption that the surface is flat and rectangular with edges that are insulated. The approach can be extended to accommodate other geometries, as follows.

Non-flat Surfaces The same approach can be used for surfaces that are not flat by ensuring the height and orientation of the spray gun(s) are adjusted so that a constant distance is maintained between the guns and the surface and that the guns are always oriented perpendicular to the surface. Under these circumstances, there will be a uniform build of mass and the surface can be considered as flat. Once the optimal scan angle, ψ, has been determined, the robot movements required to maintain constant offset and orientation to the surface along this path can be determined.

Circular Surfaces The method can be adapted to accommodate surface with circular geometry by expressing the problem in terms of cylindrical polar co-ordinates, (r, ξ). Under these circumstances, the spatial modes become $$\phi_{m,n}(r,\xi) = \begin{cases} J_0(\lambda_{m,0}r) & \text{for } n=0;\ m=1,2,3,\ldots \\ J_n(\lambda_{m,n}r)\cos n\xi & \text{for } n=1,2,3,\ldots;\ m=0,2,4,\ldots \\ J_n(\lambda_{m,n}r)\sin n\xi & \text{for } n=1,2,3,\ldots;\ m=1,3,5,\ldots \end{cases} \tag{94}$$

where $J_n(r)$ are the nth order Bessel functions of the first kind and $\lambda_{m,n}$ are chosen to satisfy the boundary conditions, which for the case where the edges are insulated are $$\left.\frac{\partial\phi_{m,n}}{\partial r}\right|_{r=r_{\max}} = 0 \tag{95}$$

with $r_{max}$ being the radius of the sprayed surface. This is particularly relevant to controlling the thermal profile in process such as the Osprey Process as described in P. S. Grant, "Spray Forming," *Progress in Materials Science*. vol. 39. pp. 497-545, 1995, herein incorporated by reference in its entirety, where objects with circular symmetry are commonly formed by spray deposition. Regulating the thermal profile during spraying in this case, controls the porosity, microstructure and yield of these processes. The approach could also be applied to spraying onto spheres or spherical shells by expressing the problem in terms of spherical polar co-ordinates.

Rotating Surfaces By transforming the co-ordinates, the thermal profile in process where the surface and/or the spray guns are rotated can be modelled and an optimal path found. This is particularly applicable for processes with circular symmetry, such as the Osprey process.

General Shapes When spraying onto surfaces that do not have a regular shape, it is more difficult to identify the spatial modes, $\phi_{m,n}(x, y)$ Under these circumstances, the "long term" thermal profile described by the partial differential equation can be modelled using a numerical method such as finite differences as described in K. W. Morton and D. F. Mayers, "*Numerical Solution of Partial Differential Equations*," Cambridge University Press, Cambridge, UK 1996, or finite elements as described in K. Eriksson et al., "*Computational Differential Equations*." Cambridge University Press. Cambridge, UK, 1996, both of these references herein incorporated by reference in their entirety. For either method, a suitable path can be found by defining a number of points around the edge of the surface and then using a non-linear optimisation method, such as simulated annealing or genetic algorithms to determine the path between the points that minimises the thermal profile. Such non-linear optimisation methods are described in M. H. Hassoun. "*Fundamentals of Artificial Neural Networks*," MIT Press, Cambridge, Mass. 1995, herein incorporated by reference in its entirety.

REFERENCES

[1] J. K. Antonio, R. Ramabhadran, and T.-L. Ling, "A framework for optimal trajectory planning for automated spray coating," *International Journal of Robotics and Automation*, vol. 12, no. 4, pp. 124-134, 1997.

[2] P. S. Grant, "Spray forming," *Progress in Materials Science*, vol. 39, pp. 497-545, 1995.

[3] K. W. Morton and D. F. Mayers, *Numerical Solution of Partial Differential Equations*, Cambridge university Press, Cambridge, UK, 1994.

[4] K. Eriksson, D. Estep, P. Hansbo, and C. Johnson, *Computational Differential Equations*, Cambridge University Press, Cambridge, UK, 1996.

[5] M. H. Hassoun, *Fundamentals of Artificial Neural Networks*, MIT Press, Cambridge, Mass., 1995.

The invention claimed is:

1. A system for incrementally depositing material comprising:

delivery means for directing material toward a deposition zone;

control means, operably coupled to the delivery means, the control means for controlling the deposition according to a derived scan path plan predicted to reduce deviation from an ideal uniform temperature profile for the deposition during the deposition process, wherein the derived scan path is derived in a protocol in which at least one of the following input considerations are accredited:

optimization criteria selected;

maximum acceptable derivation from desired thermal profile;

dimensions of deposition zone;

size/dimensions or deposition footprint;

scan velocity.

2. A system according to claim 1, wherein at least one of the delivery means and the control means is operable to produce a pattern of material deposition over the deposition zone according to the derived scan path plan.

3. A system according to claim 1, wherein the derived scan path plan comprises substantially a mirrorbox scan path plan.

4. A system according to claim 1, wherein the derived scan path plan includes a plurality of angled scan passes that intersect one another.

5. A system according to claim 1, wherein the derived scan path plan comprises reflected scan passes.

6. A system according to claim 5, wherein the reflected scan passes have an angle of incidence to normal substantially equal to an angle of reflection to normal.

7. A system according to claim 5, wherein the reflected scan passes have an angle of incidence to normal substantially different to an angle of reflection to normal.

8. A system according to claim 1, wherein the system has a predetermined scan angle defining the derived scan path plan.

9. A system according to claim 1, wherein the derived scan path plan is related to the thermal footprint of the material delivered by the delivery means.

10. A system according to claim 9, wherein the relationship between the derived scan path plan and the thermal footprint of the material delivered by the delivery means defines a predetermined scan angle ($\psi$) for the derived scan path plan.

11. A system according to claim 9, wherein the relationship between the derived scan path plan and the thermal footprint of the material delivered by the delivery means, is such that when defining the thermal footprint in terms of a 2-dimensional Fourier series, an optimal scan angle ($\psi$) is selected to avoid excitation of lower order modes.

12. A system according to claim 1, wherein the material deposited is metal delivered in-flight in molten droplet form from the delivery means.

13. A system according to claim 1, wherein the delivery means is arranged to deliver the material in-flight toward the delivery zone.

14. A system according to claim 1, wherein the delivery means comprises spray delivery means.

15. A system according to claim 1, wherein the delivery means is arranged to deliver molten droplets of material in a conveying gas.

16. A system according to claim 1, wherein the control means cooperates with the deposition means to deposit material in accordance with the a predetermined path plan having a predetermined scan rate across the deposition zone.

17. A system according to claim 1, wherein the control means cooperates with deposition means to deposit material in accordance with a predetermined path plan having a predetermined scan movement direction.

18. A system according to claim 1, wherein the derived scan path plan comprises a predetermined path plan derived by:

i) consideration of spatial modes; and ii) selecting spatial modes to optimise the path plan length.

19. A system according to claim 18, wherein selection of spatial modes is conducted to avoid excitation of lower order modes.

20. A system according to claim 1, wherein the derived scan path plan preferably reflects at boundaries to form an overcrossing pattern at the deposition zone.

21. A system according to claim 1, wherein the derived scan path plan comprises a repeating pattern returning to a staff point following a plurality of scan passes over the deposition zone.

22. A system according to claim 1, wherein the derived scan path plan comprises a non-repeating pattern.

23. A system according to claim 22, wherein a correction step operates to return the derived scan path plan to a common path point following a finite number of scan passes.

24. A system according to claim 1, wherein the spray delivery means comprises a spray gun and plural axis movable positioning apparatus.

25. A system according to claim 1, wherein the derived scan path plan has a scan angle set in a feed back loop to determine the optimum scan angle.

26. A system according to claim 25, wherein an optimum scan angle is determined in accordance with a control routine as follows:

Having regard for the footprint of the spray gun, $\mathfrak{f}(x, y, t)$, the coefficients $\mathfrak{b}_{m,n}$, are determined;

Upper bounds, M and N are determined, such that $\{\mathfrak{b}_{m,n} \approx 0 : m>M;\ n>N\}$;

Integers μ, ν are selected such that $\mu \leqq M$ and $\nu \leqq N$ and $\mu \geqq \nu$ and μ and ν have no common factors;

a scan angle (ψ) is set to $$\tan\psi = \frac{\mu L_y}{\nu L_x}$$

where $L_x$ is a first dimension in a first direction and $L_y$ is a second dimension in a second direction orthogonal to the first direction;

Search over all modes, $\{m=1, 2, \ldots, M, n=1, 2, \ldots, N\}$ to ensure that all $q_{m,n}(t)$ satisfy the optimisation criterion for this scan angle;

If the criterion is not satisfied, increase ν and/or μ and repeat preceding steps (from 'Integers μ, ν are selected' step);

If the criterion is satisfied, check that path satisfies mass deposition criterion;

If the mass deposition criterion is not satisfied, increase ν and/or μ and repeat preceding steps (from 'Integers μ, ν are selected' step);

If mass deposition criterion is satisfied, use scan angle, ψ to generate robot path and download to control scan.

27. A system according to claim 1, further comprising means for monitoring the temperature history of one or more regions of material deposited at the deposition zone.

28. A system according to claim 27, wherein the control means is adapted to vary the operation of the delivery means dependent upon the monitored temperature history of the deposit.

* * * * *